US009126081B2

(12) United States Patent
Hockridge et al.

(10) Patent No.: US 9,126,081 B2
(45) Date of Patent: Sep. 8, 2015

(54) LATERAL DELTOID EXERCISE MACHINE WITH ROCKING USER SUPPORT

(71) Applicant: Hoist Fitness Systems, Inc., San Diego, CA (US)

(72) Inventors: Bruce Hockridge, San Diego, CA (US); Jeffrey Owen Meredith, San Diego, CA (US); Adam S. Guier, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 0 days.

(21) Appl. No.: 13/657,643

(22) Filed: Oct. 22, 2012

(65) Prior Publication Data

US 2013/0109542 A1 May 2, 2013

Related U.S. Application Data

(60) Provisional application No. 61/554,356, filed on Nov. 1, 2011.

(51) Int. Cl.
*A63B 21/06* (2006.01)
*A63B 23/12* (2006.01)
(Continued)

(52) U.S. Cl.
CPC ..... *A63B 23/1272* (2013.01); *A63B 21/062* (2013.01); *A63B 21/1465* (2013.01);
(Continued)

(58) Field of Classification Search
CPC ..... A63B 23/1272; A63B 21/1492; A63B 21/1465; A63B 21/062; A63B 21/00007; A63B 21/00018; A63B 21/00032; A63B 21/00047; A63B 21/000185; A63B 21/15; A63B 21/151; A63B 15/154; A63B 2021/0623; A63B 2021/0626; A63B 23/0355; A63B 23/12; A63B 23/1245; A63B 23/1254; A63B 23/1263
USPC ..... 482/92–94, 97–101
See application file for complete search history.

(56) References Cited

U.S. PATENT DOCUMENTS 5,554,083 A 9/1996 Chen
7,029,427 B2 * 4/2006 Vuurmans et al. ..... 482/100
(Continued)

FOREIGN PATENT DOCUMENTS

CN 2341670 Y 10/1999
FR 2544618 A1 10/1984
WO 0238230 A1 5/2002

OTHER PUBLICATIONS

Extended European Search Report for related EP 12190613.5, dated Mar. 4, 2013, in 6 pages.
(Continued)

*Primary Examiner* — Loan H Thanh
*Assistant Examiner* — Megan Anderson
(74) *Attorney, Agent, or Firm* — Jones Day

(57) ABSTRACT

A lateral deltoid exercise machine has a floor engaging main frame, a user support pivot, a user support assembly pivotally mounted on the main frame via the user support pivot, and a pivotally mounted user engagement device or exercise arm assembly having arm pads for engagement by the user's forearms while pushing the arm pads outward and upward from a start position. A connecting link translates movement of the user engagement device to movement of the user support so that pivotal movement of the user engagement device results in a self-aligning, pivoting movement of the user support.

23 Claims, 37 Drawing Sheets

(51) Int. Cl.

| | |
|---|---|
| ***A63B 21/062*** | (2006.01) |
| ***A63B 23/035*** | (2006.01) |
| ***A63B 21/00*** | (2006.01) |
| *A63B 22/00* | (2006.01) |

(52) U.S. Cl.
CPC ..... *A63B21/1492* (2013.01); *A63B 23/03533* (2013.01); *A63B 22/0087* (2013.01); *A63B 2208/0233* (2013.01)

(56) References Cited

U.S. PATENT DOCUMENTS

| | | | |
|---|---|---|---|
| 7,331,911 | B2 | 2/2008 | Webber et al. |
| 7,335,140 | B2 | 2/2008 | Webber et al. |
| 7,361,125 | B2 | 4/2008 | Webber et al. |
| 7,549,949 | B2 | 6/2009 | Webber et al. |
| 7,563,209 | B2 | 7/2009 | Webber et al. |
| 7,594,880 | B2 | 9/2009 | Webber et al. |
| 7,601,106 | B2 * | 10/2009 | Gautier ..... 482/103 |
| 7,654,940 | B2 | 2/2010 | Webber et al. |
| 7,670,269 | B2 | 3/2010 | Webber et al. |
| 7,717,832 | B2 * | 5/2010 | Webber et al. ..... 482/100 |
| 7,731,638 | B2 * | 6/2010 | Webber et al. ..... 482/72 |
| 7,794,371 | B2 | 9/2010 | Webber et al. |
| 7,794,372 | B1 | 9/2010 | Webber et al. |
| 7,867,149 | B1 | 1/2011 | Webber et al. |
| 7,938,760 | B1 | 5/2011 | Webber et al. |
| 7,993,251 | B1 | 8/2011 | Webber et al. |
| 2003/0144116 | A1 | 7/2003 | Carter |
| 2011/0207584 | A1 | 8/2011 | Webber et al. |
| 2011/0224052 | A1 | 9/2011 | Webber et al. |
| 2011/0224058 | A1 | 9/2011 | Webber et al. |

OTHER PUBLICATIONS

Hoist Fitness Systems. H51525 Lateral Deltoid Owner's Manual. Feb. 2003. 45 pages.

* cited by examiner

LATERAL DELTOID EXERCISE MACHINE WITH ROCKING USER SUPPORT

RELATED APPLICATION

The present application claims the benefit of U.S. provisional patent application No. 61/554,356 filed Nov. 1, 2011, which is incorporated herein by reference in its entirety.

BACKGROUND

1. Field of the Invention

This invention relates generally to exercise machines for performing isolation exercises, and is particularly concerned with a lateral raise or deltoid exercise machine.

2. Related Art

The shoulder or deltoid muscle is made up of three sets of muscles or muscle fibers, specifically anterior fibers, lateral fibers, and posterior fibers, referring to the location on the shoulder. In order to perform a lateral deltoid exercise, the arms are rotated outward and upward about the shoulder joint. This exercise can be performed as a free weight exercise, with the arms initially hanging at the sides of the body and the hands gripping dumbbells with the palms facing inward and elbows bent.

In known lateral deltoid machines, the user is seated in a stationary position and engages arm pads on exercise arms at each side of the seat with their arms bent at the elbow and their hands gripping handles at the ends of the exercise arms. The arms are then rotated to push the exercise arms upward and outward against an exercise resistance or load. This type of exercise does not exercise all of three sets of shoulder or deltoid muscles evenly.

SUMMARY

A deltoid exercise machine in one embodiment has a moving user engagement device and a connecting linkage which translates movement of the user engagement device into rocking movement of the user support.

The deltoid exercise machine in a first embodiment has a user support which is pivotally mounted on a stationary main frame and linked to a moving user engagement device or exercise arm assembly, so that movement of the user engagement device during an exercise is translated into rotation of the user support about its pivot axis. In the first embodiment, the user support comprises a user seat and the user engagement device comprises left and right pivoted exercise arms configured for engagement by the user's forearms and hands when seated on the user support. The exercise arms are pivotally mounted on a stationary support frame for movement outwardly and upwardly from respective rest positions on opposite sides of the user support. A connecting linkage translates movement of the exercise arms into movement of the user support. An exercise resistance or load is associated with the exercise arms, user support, or connecting linkage for resisting the deltoid exercise movement.

The combined movement of the user support and exercise arms provides a safer, more natural feeling exercise motion that constantly adjusts the position of the user during the exercise to maintain proper alignment between the parts throughout the exercise. In one embodiment, the user support seat is rotated forward as the exercise arms are rotated upward, and the user's arms do not follow the upper torso with the user seat rotation. The shift between these body parts throughout the exercise alters the demand on the deltoid muscle to shift from the front of the muscle rearward, providing a greater range of muscle engagement during the exercise as compared to a deltoid machine with a stationary support. The result is a more natural feeling exercise movement that more closely replicates the movement found in a corresponding free weight exercise, and a more uniform exercise of the entire deltoid muscle. In an alternative embodiment, the user support seat rotates rearward as the exercise arms move outward and upward from the start to the end of the exercise, so that the demand on the deltoid muscle shifts from the rear to the front during the exercise.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
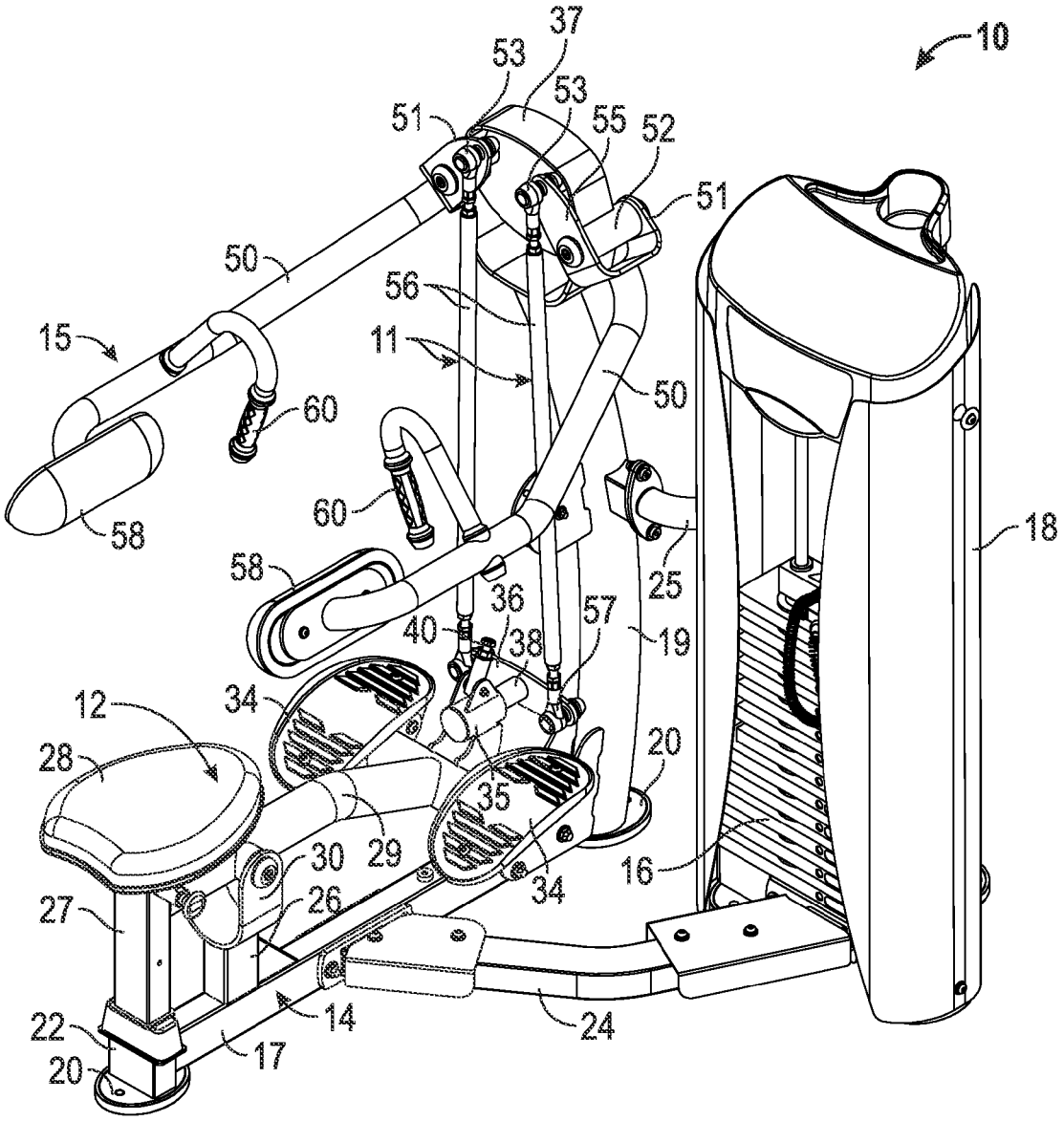
FIG. 1 is a rear perspective view of a lateral deltoid exercise machine according to a first embodiment, with the machine in a start position for a deltoid exercise.

Certain embodiments as disclosed herein provide for a lateral deltoid exercise machine with a rocking user support. Both the user support and a user engagement device or exercise arm assembly move during an exercise, with a connecting linkage translating movement of the user engagement device to rocking movement of the user support so that the user support tracks the user engagement device to adjust the position of the user relative to the user engagement device during the exercise and provide more uniform muscle exercise and better stability to the user.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 11 illustrate a first embodiment of a lateral deltoid exercise machine 10, while FIGS. 12A to 15 illustrate a user in an exercise position on the machine and performing a deltoid exercise. The deltoid exercise machine 10 in the illustrated embodiment has a user support 12 which is pivotally mounted on a stationary main frame 14 and linked to a moving user engagement device or exercise arm assembly 15 via connecting linkage 11 so that movement of the user engagement device during an exercise is translated into rotation of the user support about its pivot axis, as described in more detail below. An exercise resistance or load is associated with the exercise arms, user support, or connecting linkage for resisting the deltoid exercise movement. In the illustrated embodiment, the exercise resistance comprises a selectorized weight stack 16 in weight stack housing 18 which is linked to the user support 12 via a cable and pulley assembly 13 illustrated in more detail in FIG. 11. Other types of exercise resistance may be linked to any of the moving parts of the machine in other embodiments, such as weight plates, rubber bands, flex rods, or hydraulic, pneumatic, or electro-magnetic resistance or loads.

Figure 3:
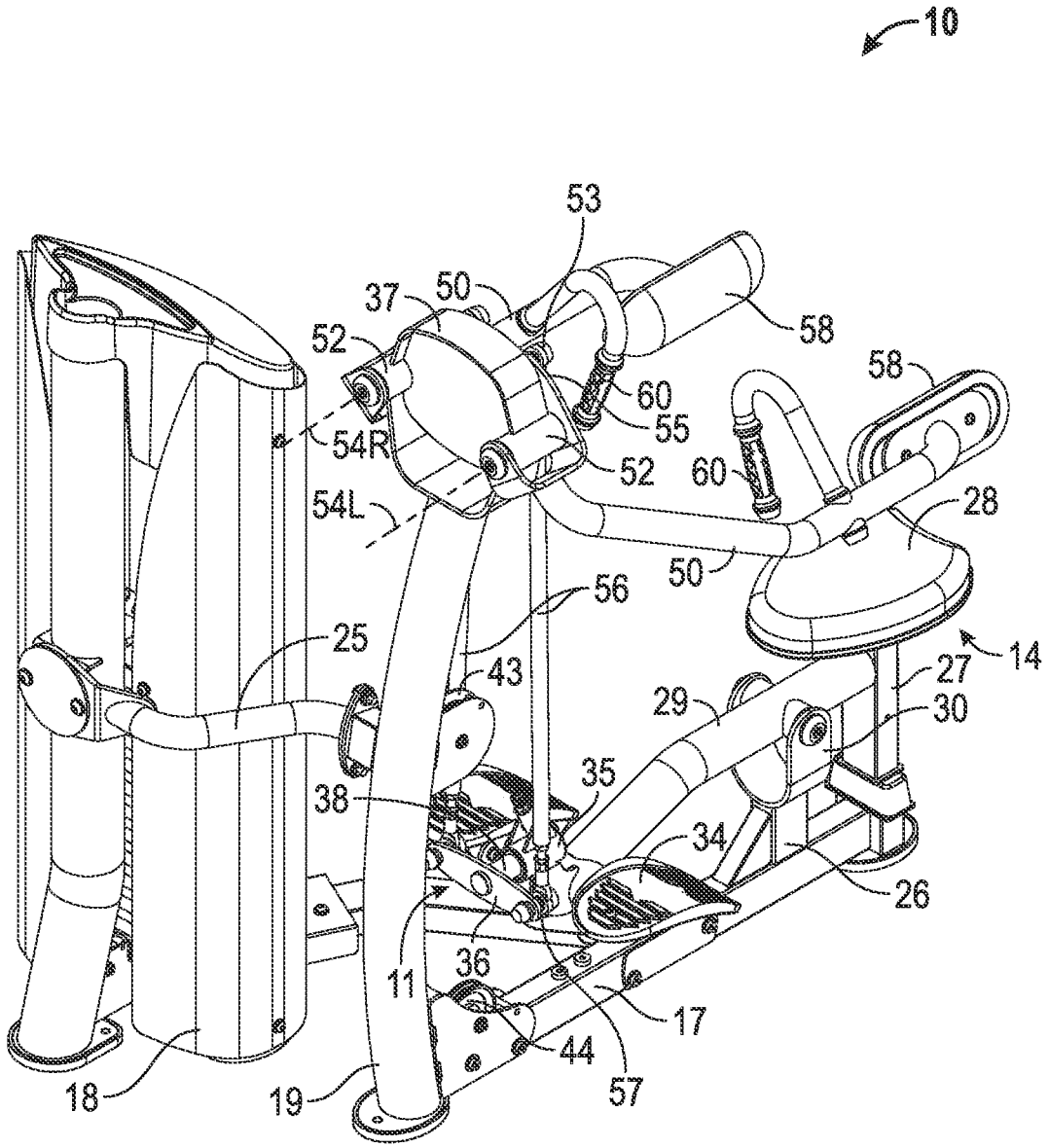
FIG. 3 is a front perspective view of the machine in the start position of FIG. 1.
Figure 4:
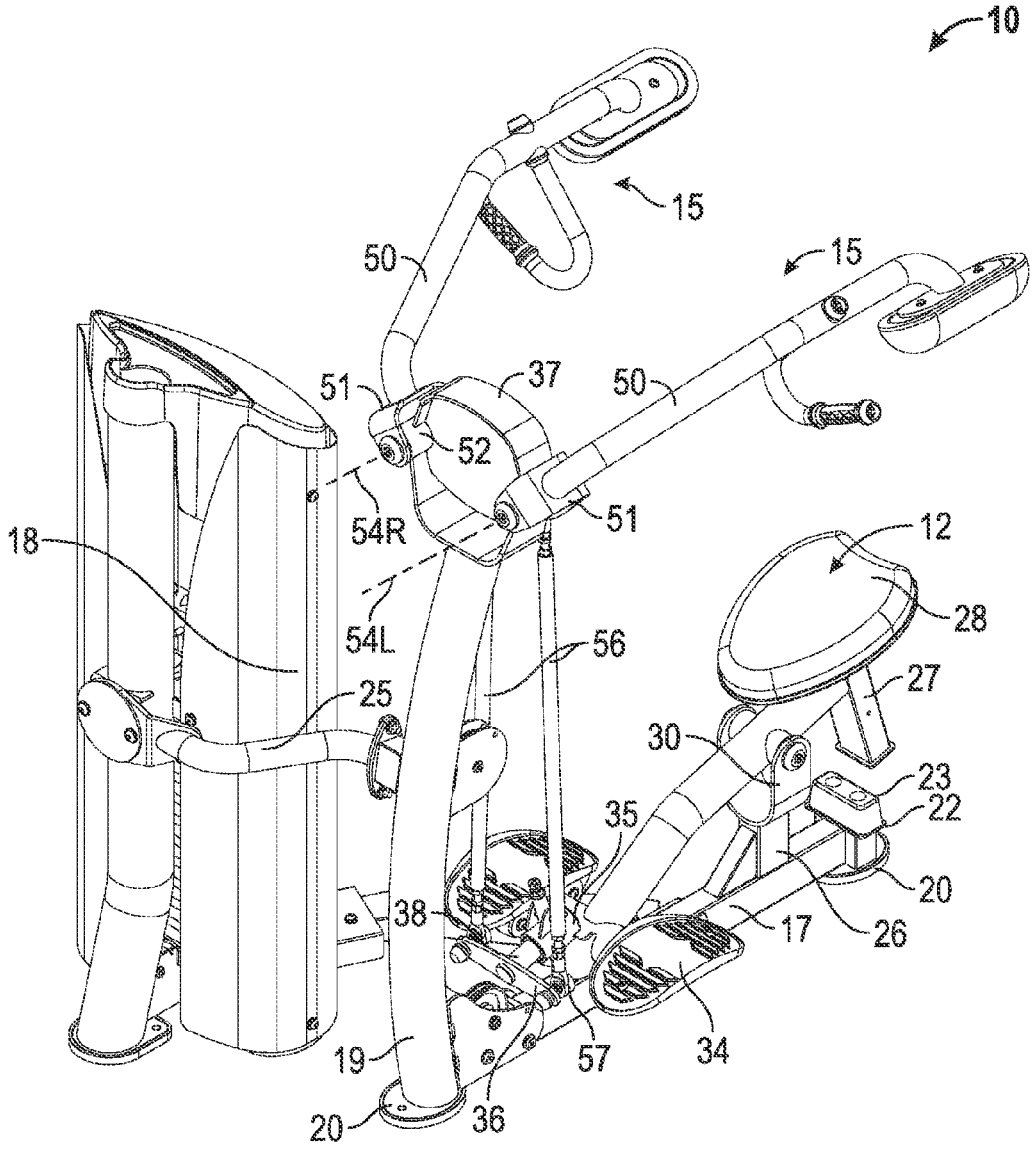
FIG. 4 is a front perspective view of the machine in the end position of FIG. 2.
Figure 10:
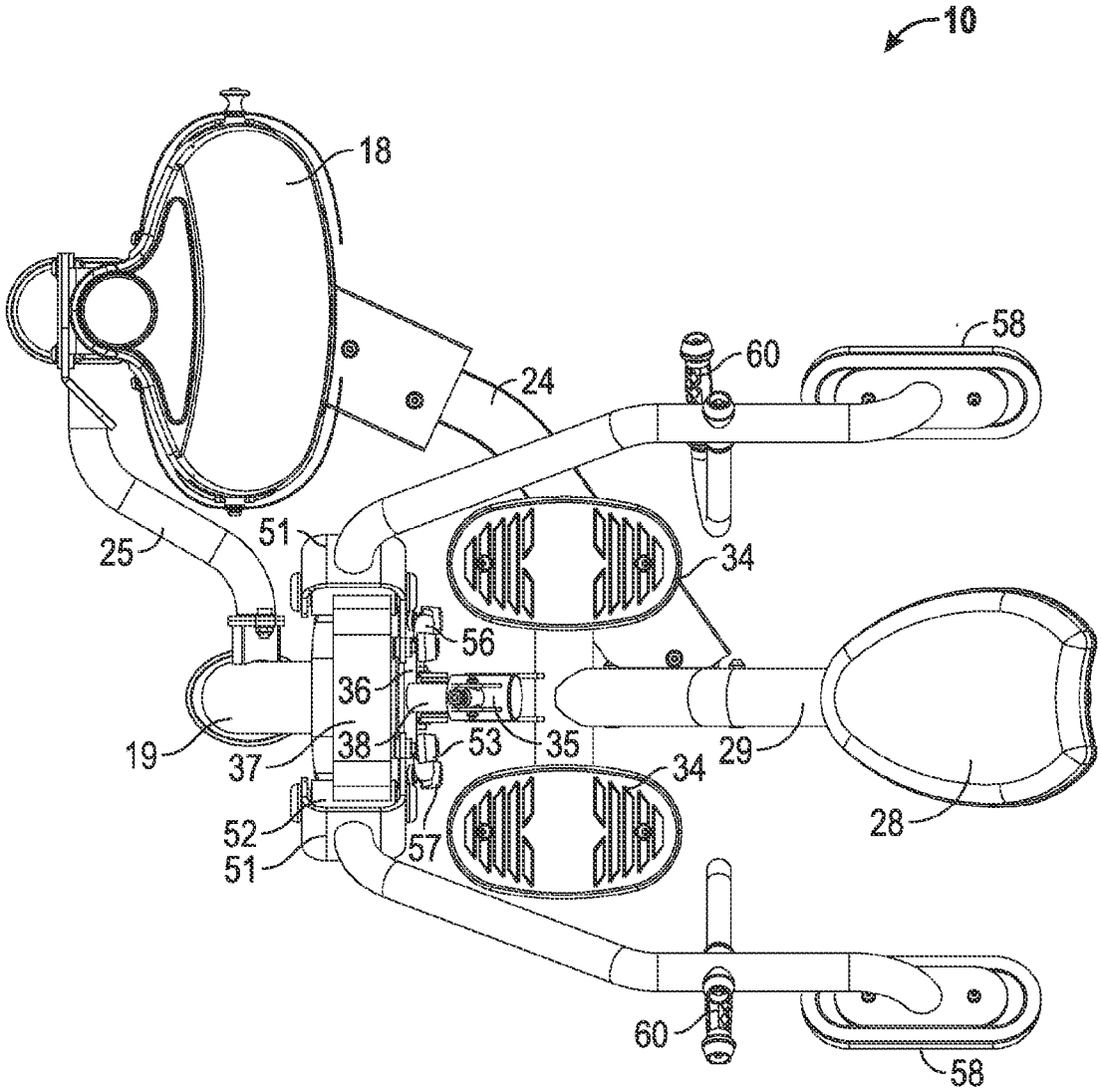
FIG. 10 is a top plan view of the machine in the end position of FIGS. 2, 4, 6 and 8.

The stationary main frame 14 has a floor engaging base strut 17, a front upright 19 which curves rearward towards the upper end, and a short stand off post 22 projecting upward from foot 20 at the rear end of strut 17. Bumper pad 23 is mounted at the top of post 22. A pivot mount housing or frame 37 extends vertically upwards from the upper end of front upright 19. Pivot sleeves 52 are secured to opposite sides of frame or pivot housing 37. The front cover of housing 37 is omitted in FIG. 1 to reveal the pivot linkage. A pivot support post 26 extends upwardly from base strut 17 at a location spaced forward from stand off post 22. An angled cable guide tube 24 extends between the base strut and the weight stack housing 18, which is positioned alongside front upright 19 to provide a relatively small footprint for the machine, as best illustrated in FIG. 10. A support strut 25 extends from a raised position on front upright 19 to the weight stack housing 18 and is secured to the rear of the housing, as illustrated in FIG. 3. The connection between the weight stack housing and main frame may be reversible so that the weight stack can be mounted on either side of the main frame.

Figure 5:
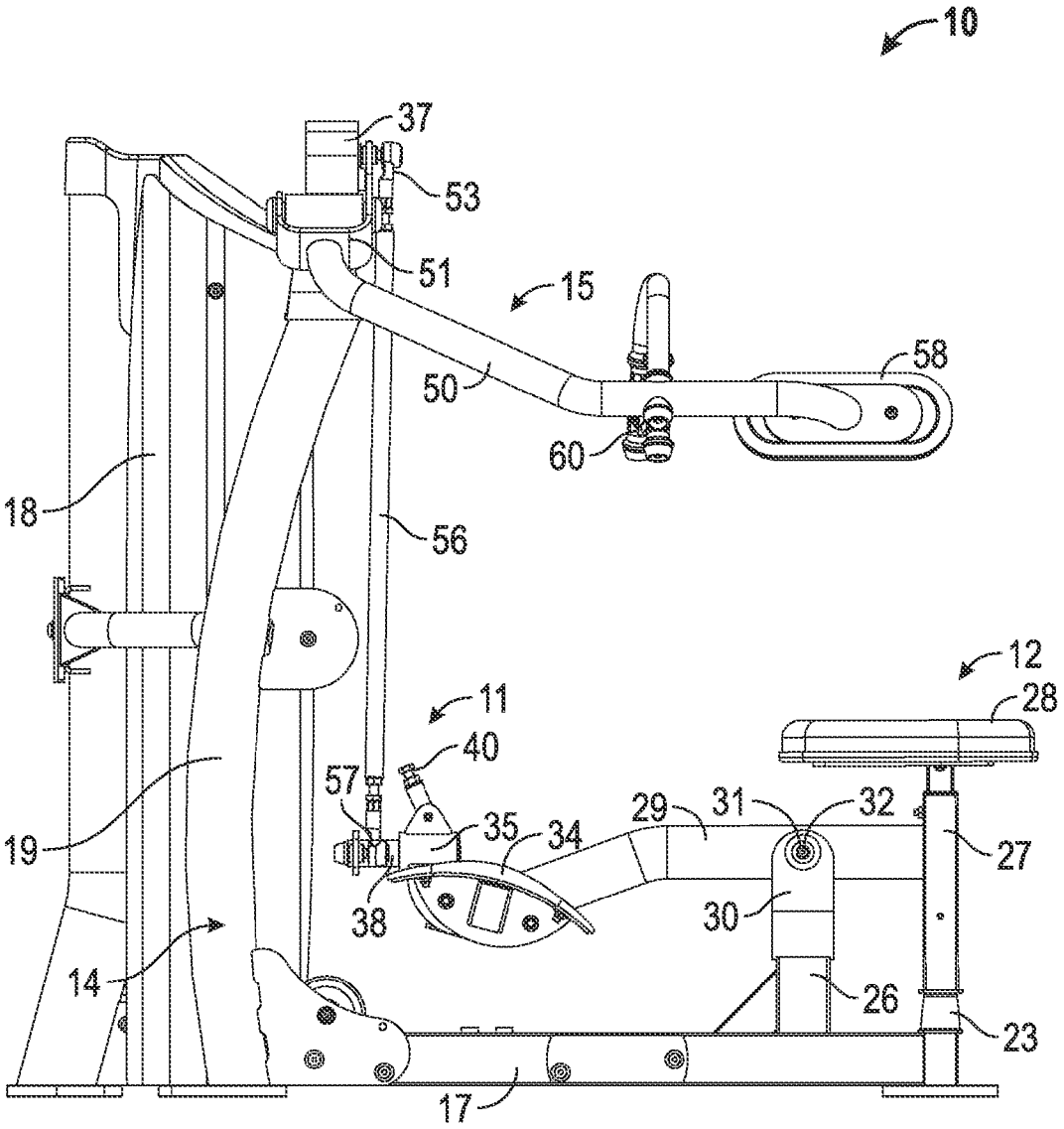
FIG. 5 is a side elevation view of the machine in the start position of FIGS. 1 and 3.
Figure 6:
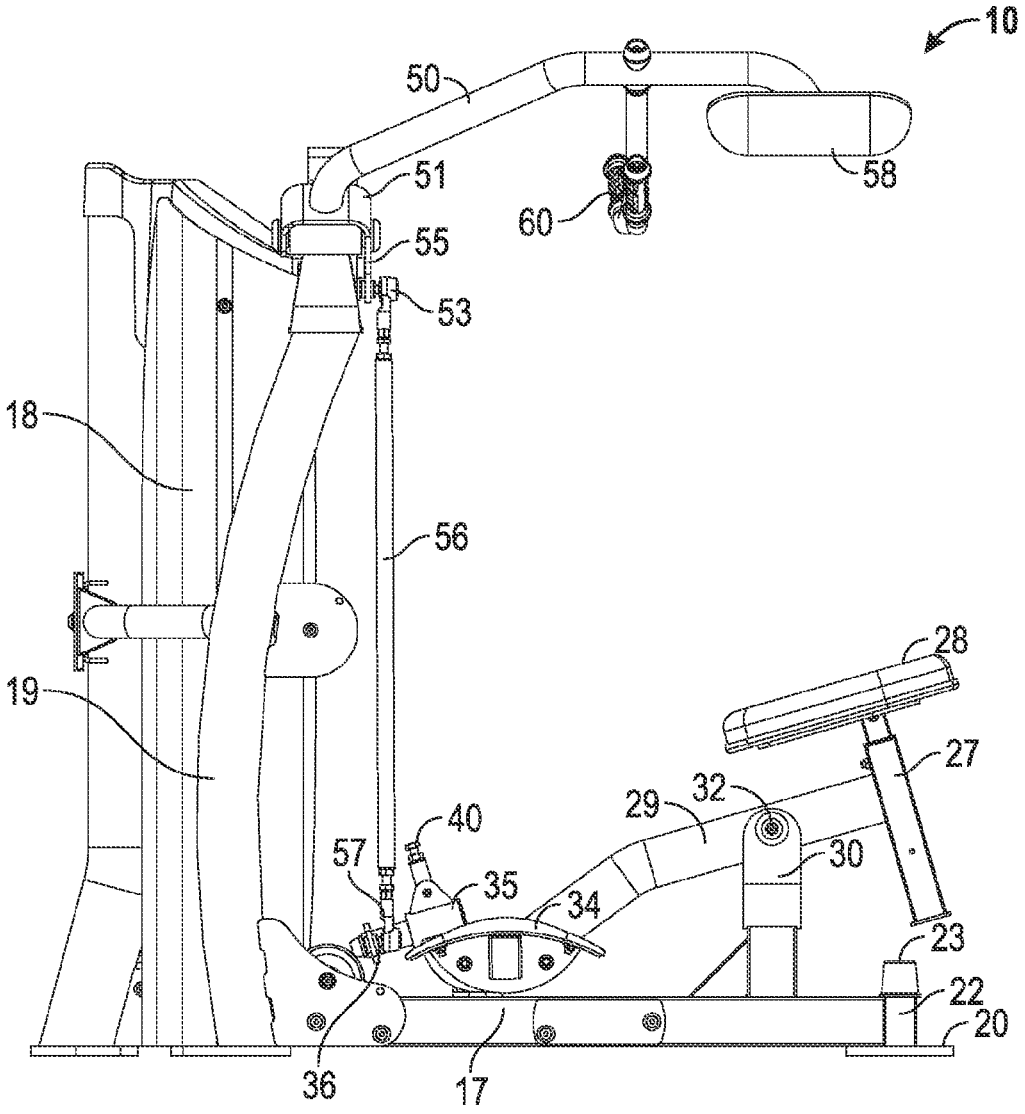
FIG. 6 is a side elevation view of the machine in the end position of FIGS. 2 and 4.

The user support 12 has telescopically adjustable support post 27 on which seat pad 28 is mounted, and a base strut 29 extending forward from post 27 beneath the seat pad, as best illustrated in FIGS. 5 and 6. The lower end of seat support post 27 rests on bumper pad 23 in the rest or start position of FIG. 5. Base strut 29 is pivotally mounted on a pivot bracket 30 at the upper end of pivot support post 26 via pivot 31 for rotation about user support pivot axis 32 which is located under a forward end of seat pad 28 in the start position of FIG. 5. The forward end of base strut 29 is inclined downwards in the exercise start position, and footrests 34 are mounted on a cross bar at the forward end of the base strut. A pivot sleeve 35 is secured to the cross bar at the forward end of the base strut 29 and swivel link 36 forming part of connecting linkage 11 is rotatably secured to sleeve 35 via mounting post 38, as best illustrated in FIGS. 1, 3, 5, 9 and 11. A cable anchor 40 is secured to the upper side of sleeve 35 and forms part of the cable and pulley linkage 13 between the weight stack and user support, as described in more detail below.

The exercise arm assembly 15 comprises left and right pivoted exercise arms 50 configured for engagement by the user's forearms and hands when seated on the user support. As best illustrated in FIGS. 1, 3, 7 and 9, each exercise arm 50 has a pivot bracket 51 secured at its forward end and pivotally mounted on a respective side of pivot housing 37 via a pivot pin extending between opposite side plates of bracket 51 and rotatably engaged in a respective pivot sleeve 52 secured to the frame 37, defining spaced, horizontal arm pivot axes 54L and 54R (FIG. 7) which are perpendicular to user support pivot axis 32. Each pivot bracket 51 has an extended side plate 55 which extends into the housing and is pivotally linked with connecting linkage 11 inside housing 37. Connecting linkage 11 comprises a pair of drive links 56 each having an upper end pivotally connected to the inner end of a respective side plate 55 via pivot connection or universal joint 53 and a lower end pivotally connected to rotating swivel link 36 via pivot connection or universal joint 57, allowing for articulating movement of the drive link relative to plate 55 at the upper end and swivel link 36 at the lower end, as seen in FIGS. 5 to 8.

Figure 7:
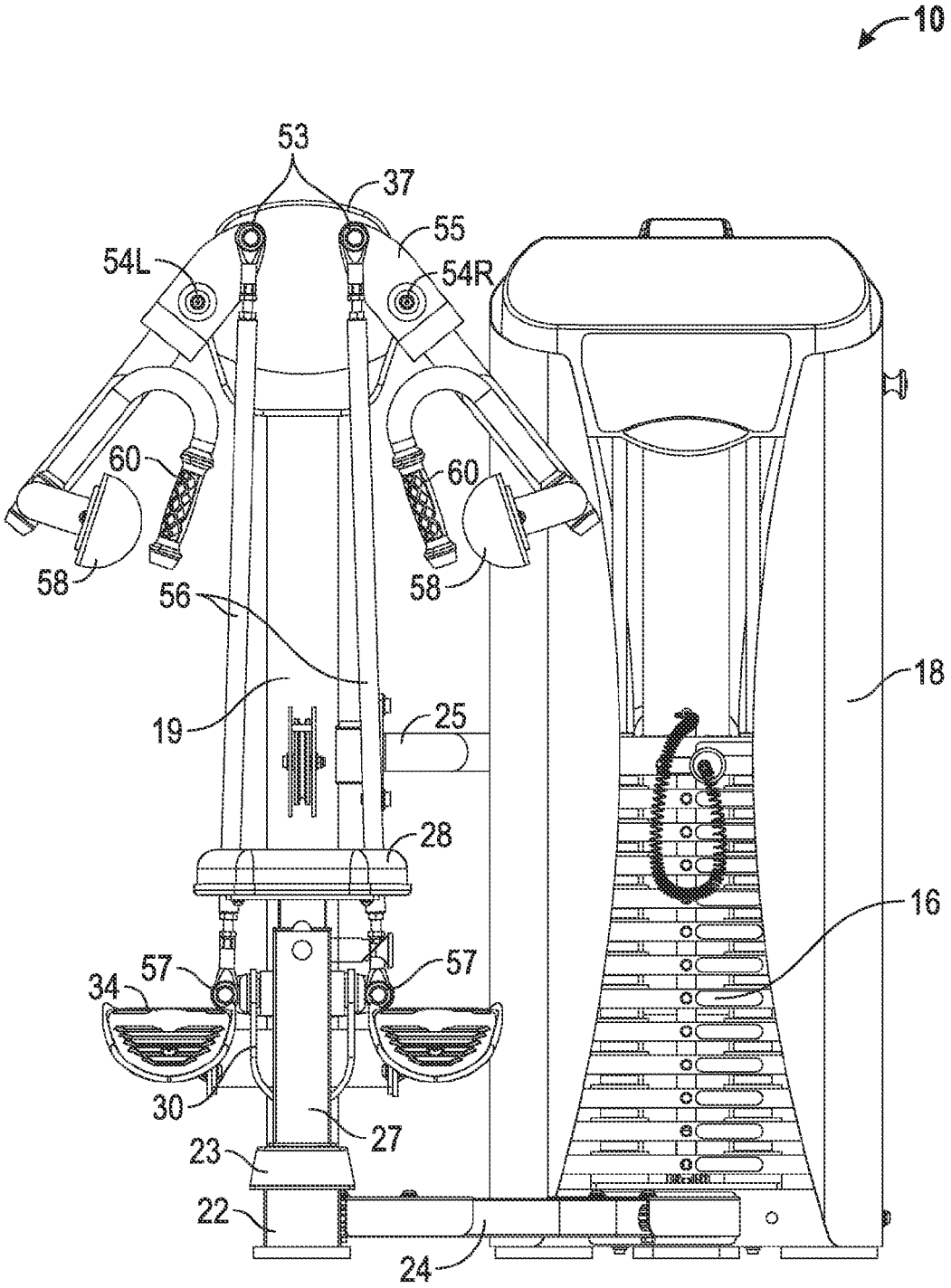
FIG. 7 is a rear elevation view of the machine in the start position of FIGS. 1, 3 and 5.
Figure 12A:
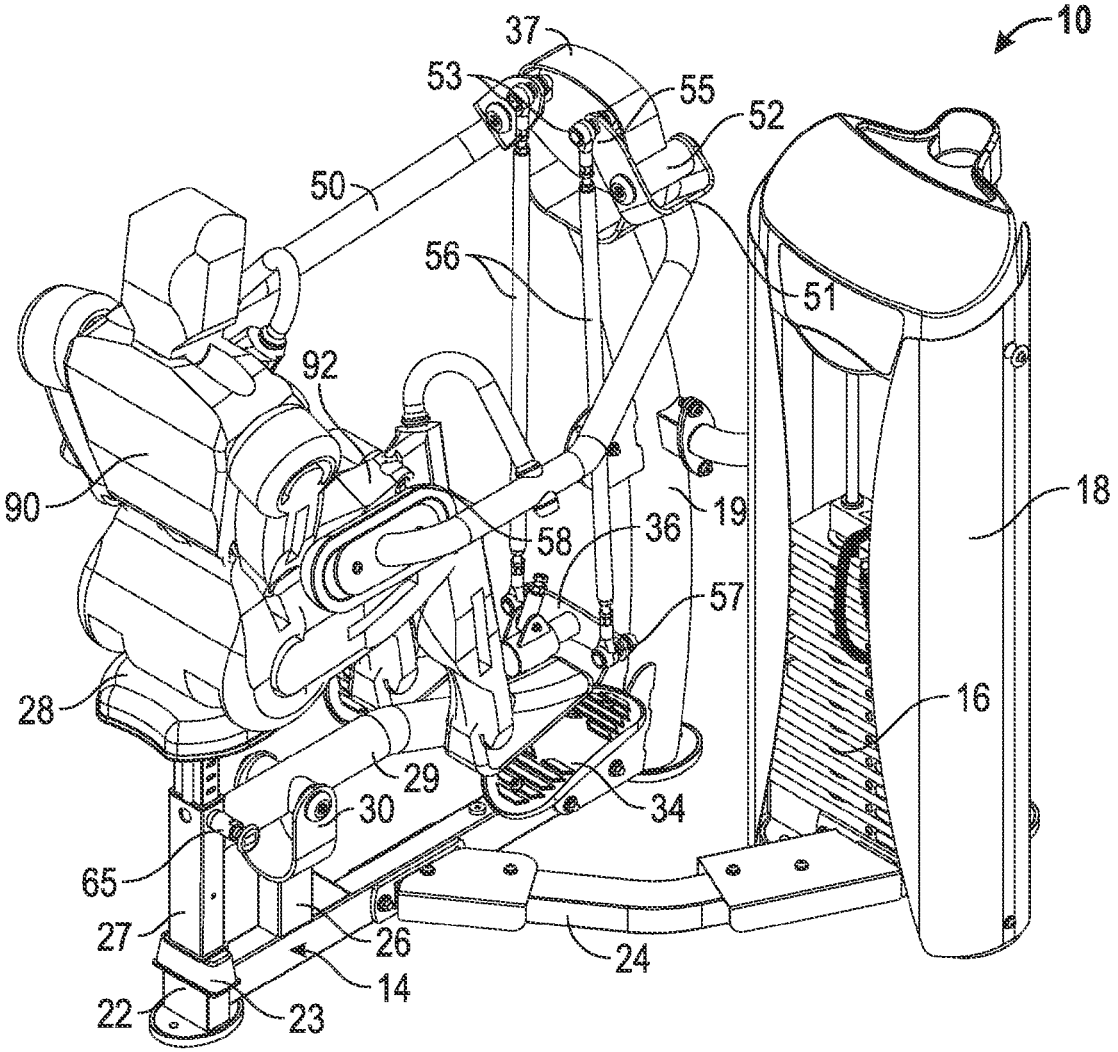
FIG. 12A is a rear perspective view of the lateral deltoid machine in the start position of FIG. 1 with a user seated on the rocking user support and engaging the exercise arms.
Figure 14A:
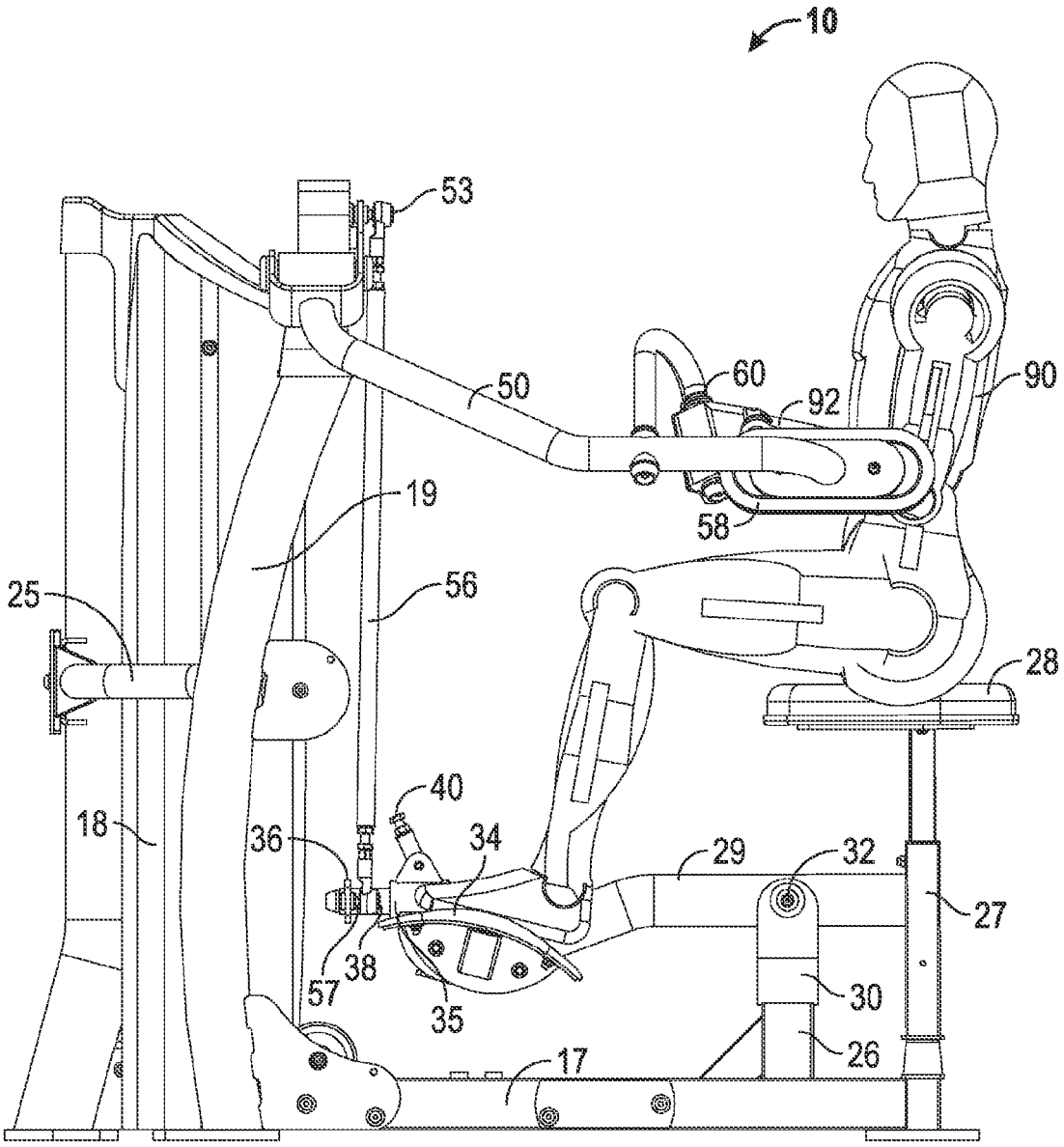
FIG. 14A is a side elevation view illustrating the machine and user in the start position of FIGS. 12A and 13A.

Each arm 50 has an arm pad 58 at its rear end and a handle or grip 60 spaced forward from arm pad 58 and configured for gripping by a user 90 with their palms facing inward and slightly downward and the back of each forearm 92 pressed against the respective arm pad 58 in the exercise start position, as best illustrated in FIGS. 12A and 14A. The arm or forearm pads 58 face inwards and are angled slightly downward in the start position, as illustrated in FIGS. 1, 3 and 7. Each forearm pad 58 is inclined outwardly from the upper to the lower end of the pad in the start position of FIG. 7.

Figure 2:
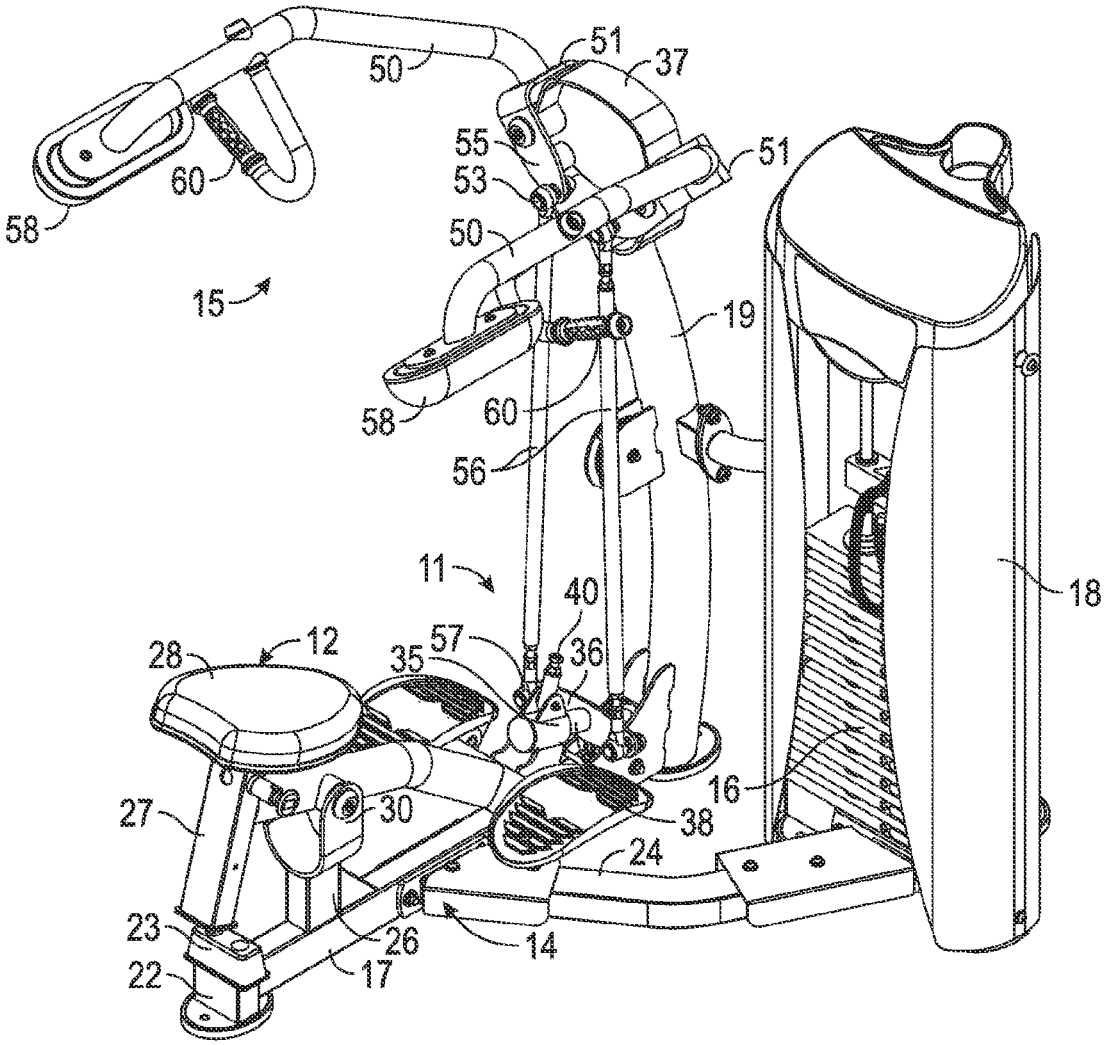
FIG. 2 is a rear perspective view similar to FIG. 1 but showing the exercise arms in an end position for a deltoid exercise.
Figure 11:
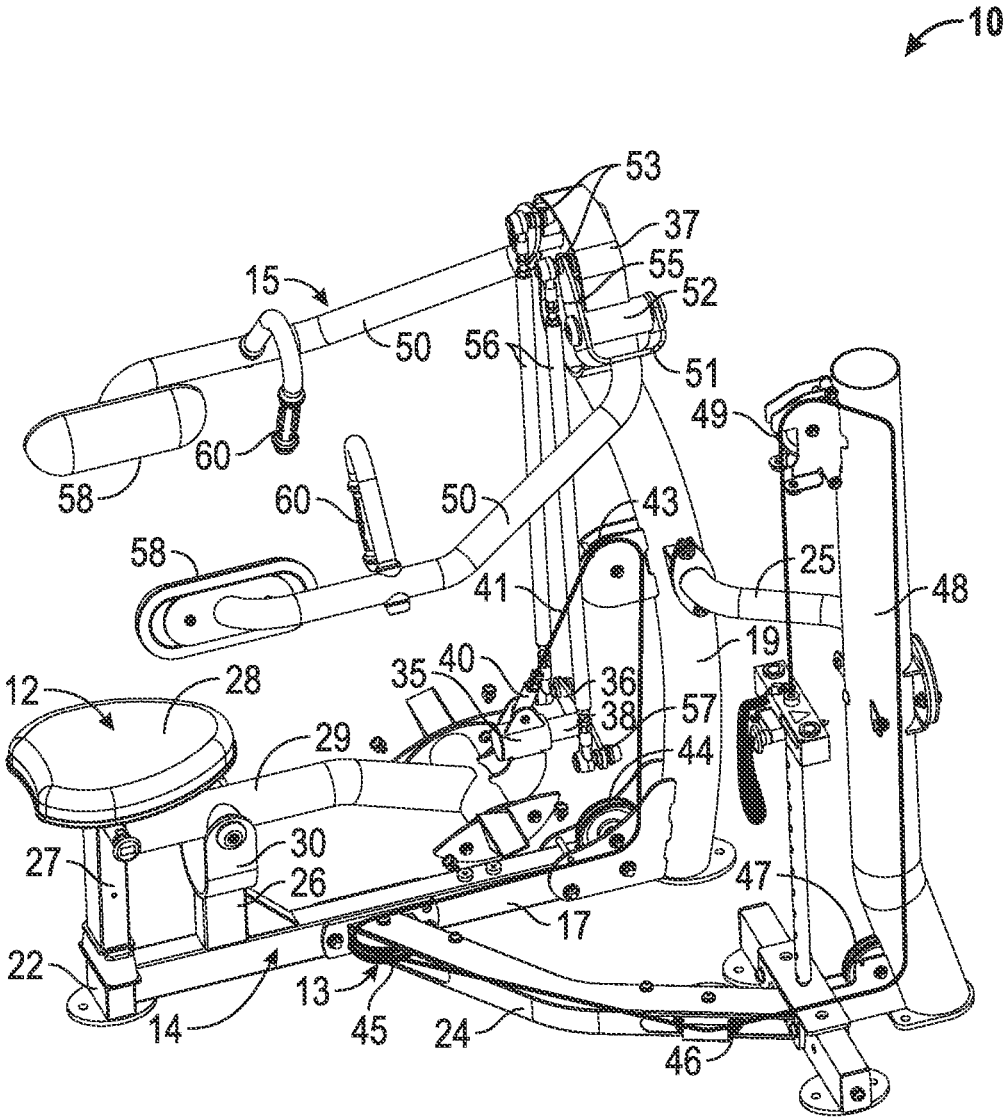
FIG. 11 is a broken away, perspective view of the machine of FIGS. 1 to 10 with some parts removed to illustrate the cable routing between the user support and exercise resistance.

The user support 12 is linked to selected weights in weight stack 16 via a cable and pulley assembly 13 in a standard manner, as best illustrated in FIG. 11, so as to provide resistance to rotation of the user support between the start and end positions of FIGS. 1 and 2. The cables of the cable and pulley assembly 13 are only shown in FIG. 11, and are omitted from the other drawings for clarity. Some parts of the machine 10 are omitted in FIG. 11 to reveal the details of the cable and pulley linkage. Cable 41 extends from base frame cable anchor 40 at the forward end of base strut 29, around a first pulley 43 on the forward upright 19 of the user support frame, and then around a second pulley 44 on the base strut 17 of the main frame at the junction between strut 17 and upright 19. Cable 41 then extends through the tubular base strut 17 and into the cable guide tube or strut 24 between the base strut 17 and weight stack housing 18, around additional guide pulleys 45, 46 in the guide tube and upwardly directed guide pulley 47 in the base of housing 18. The cable 41 is then guided through upright guide tube or strut 48 of the weight stack housing and around guide pulleys 49 at the top of housing 18, and extends downward for connection to a selected number of weights in weight stack 16 in the standard manner.

The user support and exercise arm pivot mounts which define pivot axes 32, 54L and 54R, together with the connecting linkage 11, define predetermined movement paths of the exercise arms and user support during an exercise. FIGS. 1, 3, 5, 7 and 9 illustrate the start or rest position of the lateral deltoid machine 10, while FIGS. 2, 4, 6, 8 and 10 illustrate an exercise end position. FIGS. 12A to 15 illustrate the same positions with user 90 seated on the machine and performing a lateral deltoid exercise. As best illustrated in FIGS. 5, 6, and 15, the seat pad 28 of the user support and the portion of base strut 29 extending from support post 27 are both substantially horizontal in the exercise start position, and are angled upward at an angle of around sixteen degrees in the end or stop position of FIG. 6.

Figure 8:
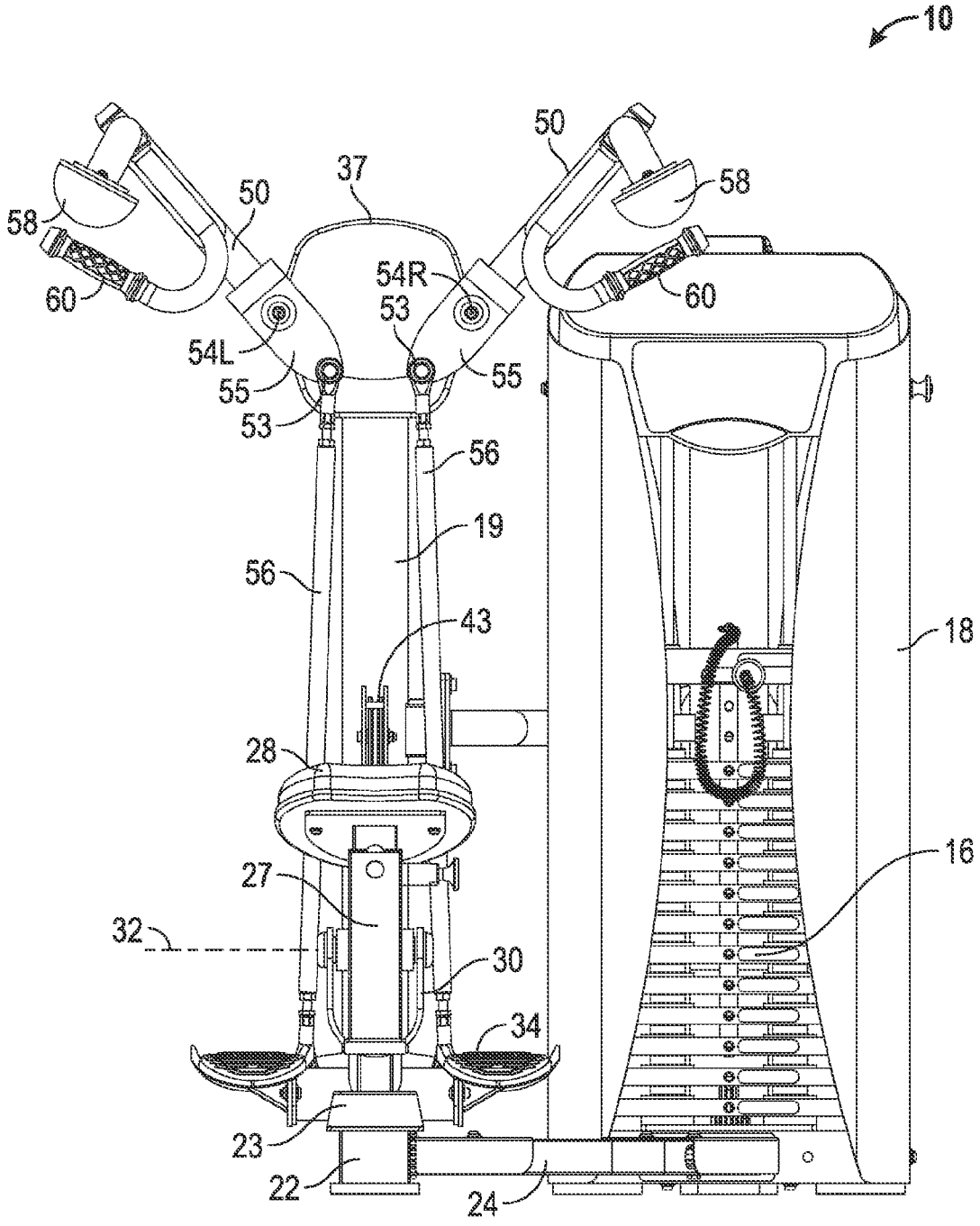
FIG. 8 is a rear elevation view of the machine in the end position of FIGS. 2, 4 and 6.
Figure 9:
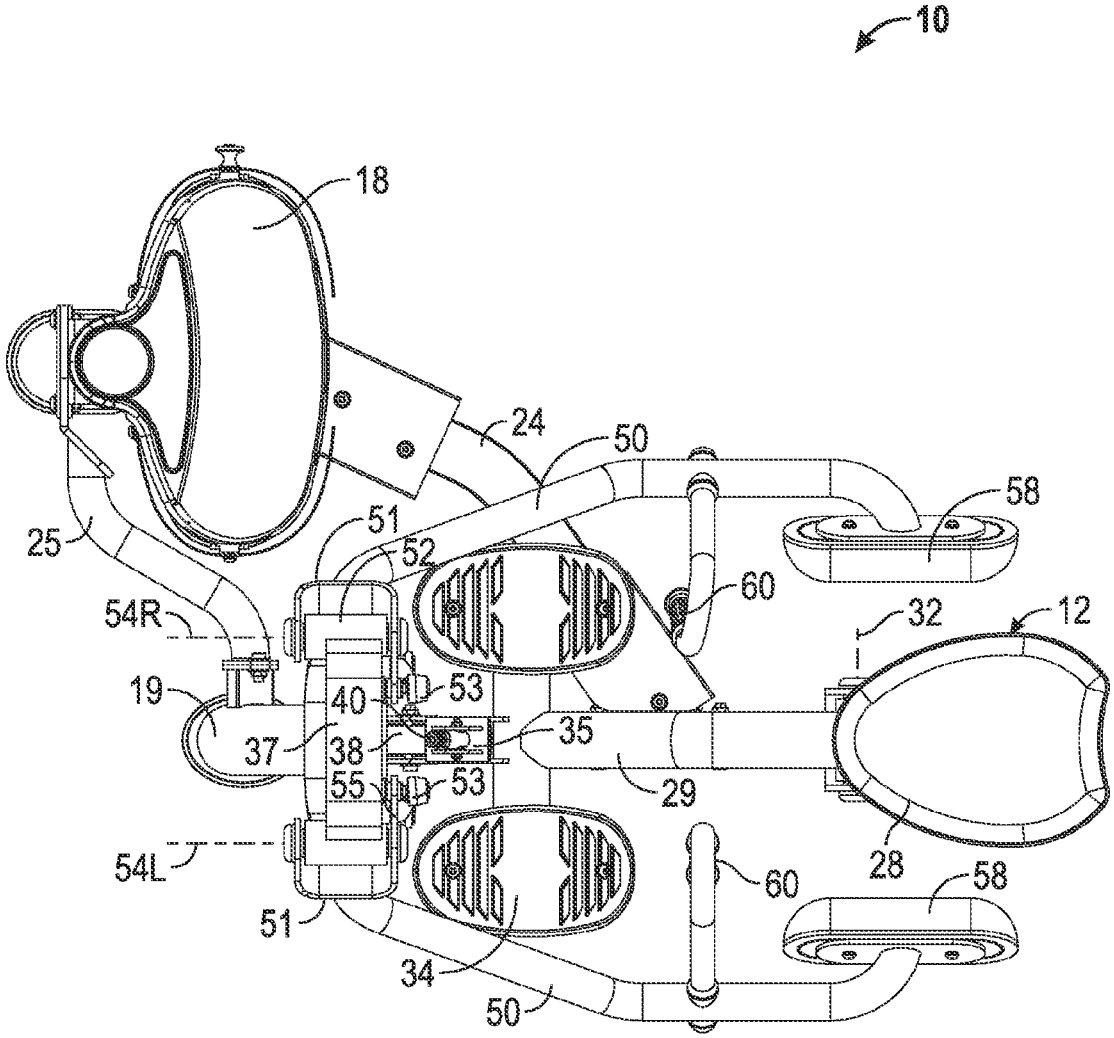
FIG. 9 is a top plan view of the machine in the start position of FIGS. 1, 3, 5 and 7.

The exercise arms 50 each rotate outward and upward between the start position of FIGS. 1, 3, 5, 7 and 9 and the end position of FIGS. 2, 4, 6, 8 and 10, while the connecting linkage 11 between each exercise arm and the forward end of the user support simultaneously rotates the user support between the start and end positions. In FIG. 15, the start and finish positions of the machine are overlapped. Part numbers followed by the letter A correspond to the solid line, start position of the rear deltoid exercise machine and part numbers followed by the letter B correspond to the dotted line, end position of the machine. As illustrated in FIG. 15, the user support rotates through an angle of sixteen degrees around the pivot axis 32 between the start position and end positions shown in solid and dotted outline, respectively, while each exercise arm 50 rotates about its respective pivot axis 54R and 54L, respectively, between lower positions 50A on opposite sides of the seat in the start position (see FIGS. 5, 9 and 15) and raised positions 50B spaced upwardly and outwardly from the start position in the end position (see FIGS. 8, 10 and 15). Each arm rotates upward through an angle of no more than 100 degrees between the start and end position. As illustrated in FIGS. 7 and 8, each lower arm or forearm pad 58 faces inwardly and is angled slightly outwards from its upper to its lower end at the start of an exercise, at an angle of around 23 degrees to the vertical orientation, and is directed downward and outward in the exercise end position.

FIGS. 12A to 14B illustrate a user 90 seated on the user support 12 and performing a lateral deltoid exercise. In order to use the lateral deltoid exercise machine 10, the user first sits on the seat pad facing the front end of the machine with their feet engaging footrests 34 and the user support in the rest or start position, as illustrated in FIGS. 12A, 13A and 14A. The height of seat pad 28 may be adjusted by the user as needed, using telescoping adjustment mechanism 65, so that the forearms line up with the arm pads 58 and handles 60 when the forearm is bent forward at the elbow, as best illustrated in FIG. 12A. Once the seat is at the proper height, the user assumes a seated position with the feet placed on the footrests and the upper torso between the arm pads 58 of exercise arms 50. The user then places the back of each forearm 92 against the respective arm pad 58 while grasping the handle 60 for stabilization. In the start position, the user's torso is straight upward, as illustrated in FIG. 14A and in solid outline in FIG. 15, and the shoulder joints are substantially lined up with the respective exercise arm axes 54L and 54R.

Figure 13A:
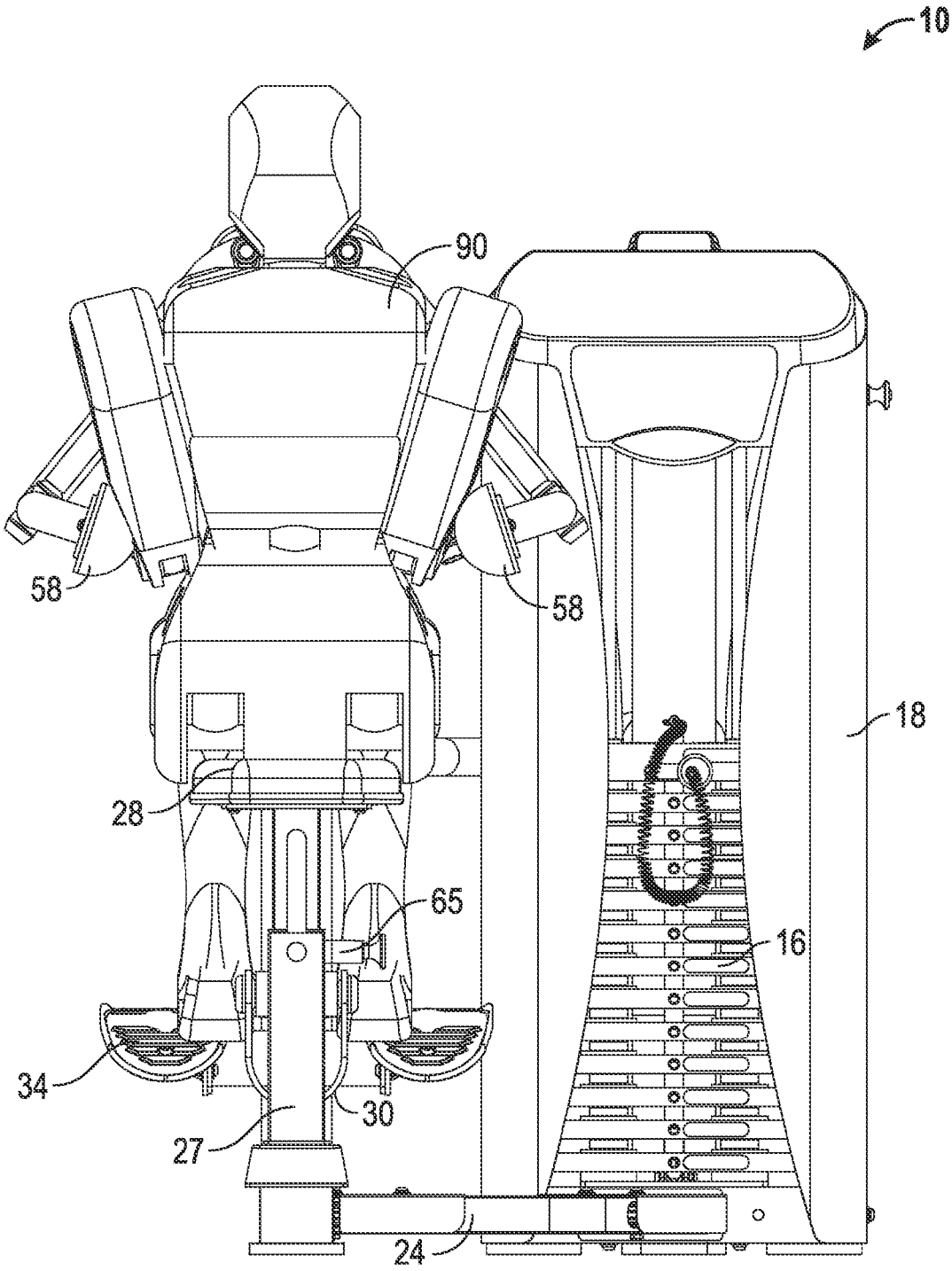
FIG. 13A is a rear elevation view illustrating the machine and user in the start position of FIG. 12A
Figure 13B:
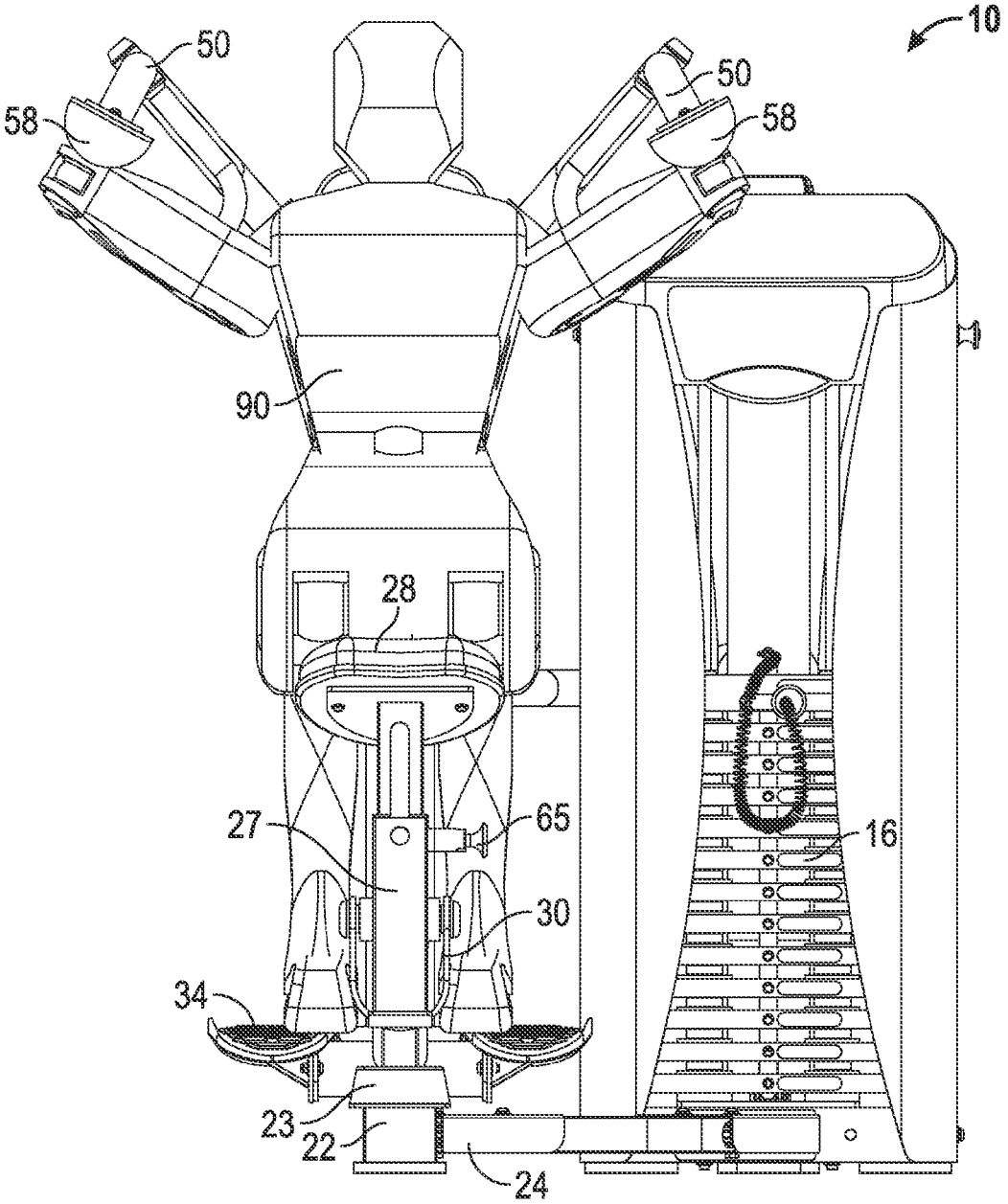
FIG. 13B is a rear elevation view illustrating the machine and user in the end position of FIG. 12B.
Figure 14B:
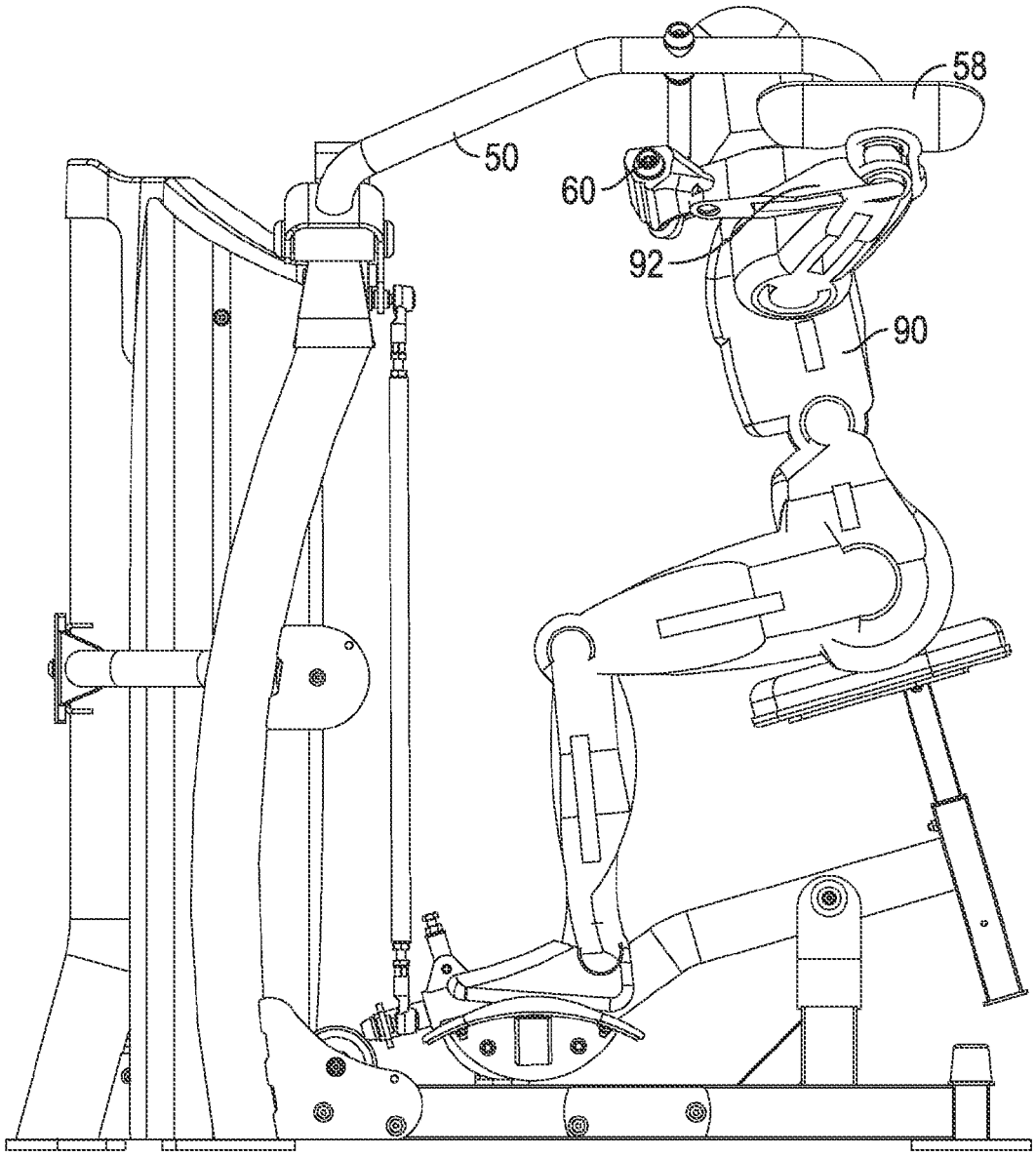
FIG. 14B is a side elevation view similar to FIG. 14A but showing the machine and user in the end position of FIG. 12B.
Figure 15:
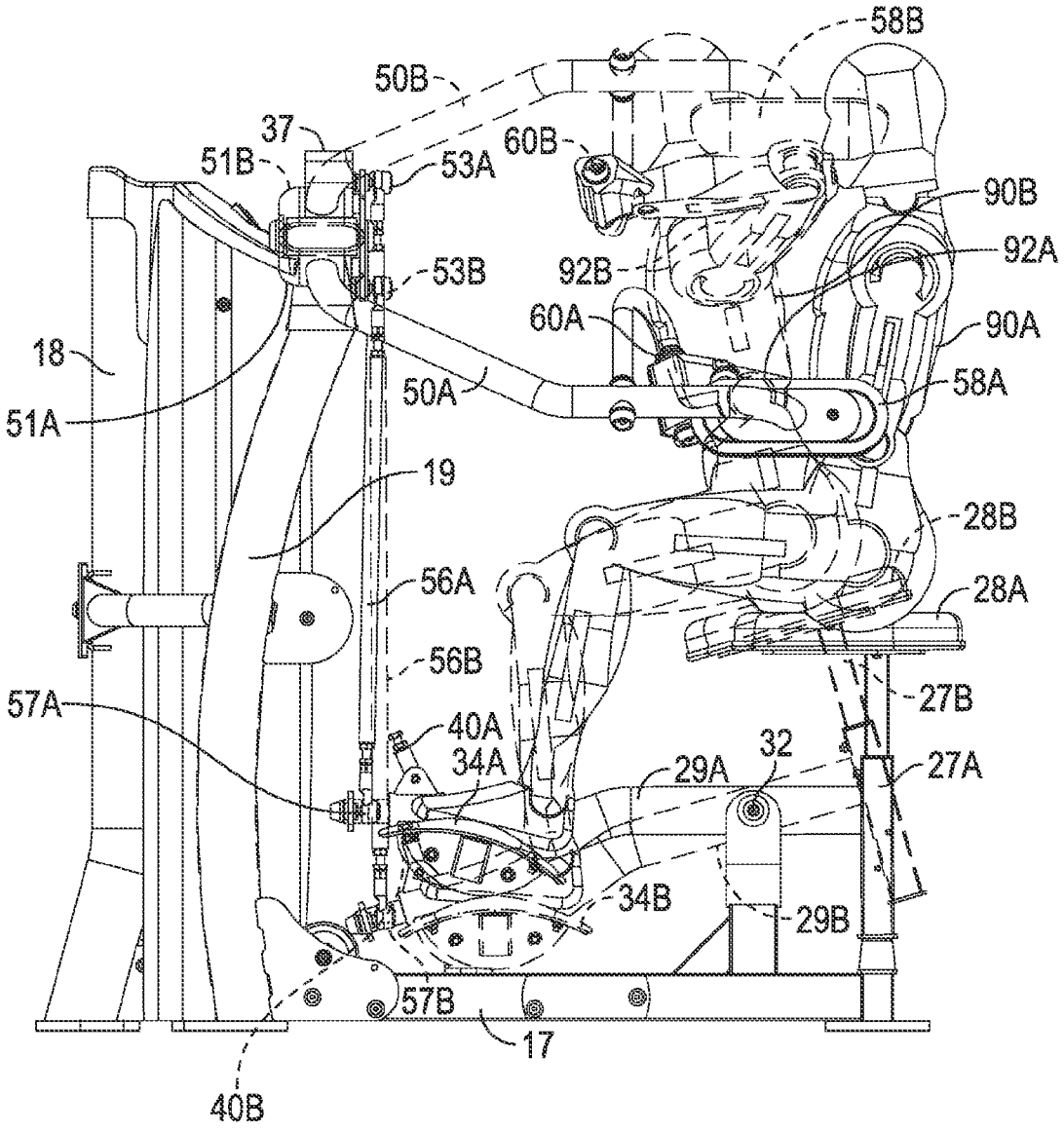
FIG. 15 is a side elevation view illustrating the two positions of FIGS. 14A and 14B superimposed, to illustrate the movements of the moving parts of the machine during an exercise.

Once properly positioned in the exercise start position, the user 90 rotates their arms upward while pressing the forearms against the arm pads 58 until the user's upper arms extend straight out at the sides in the exercise end position, as indicated in FIGS. 13B and 14B. The user then returns the arms to the starting position and repeats the exercise for the desired number of repetitions.

Figure 12B:
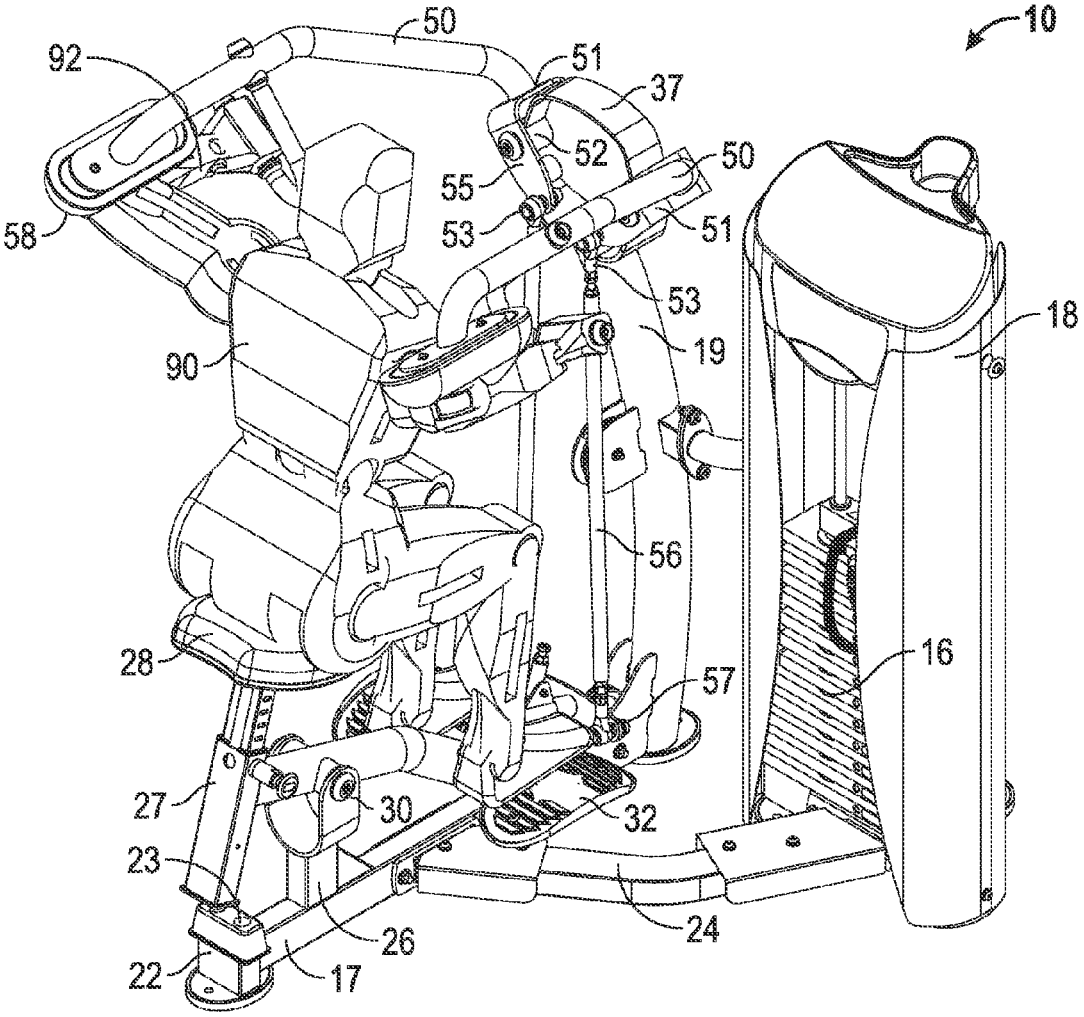
FIG. 12B is a rear perspective view similar to FIG. 12A but showing the machine and user in an end position for a deltoid exercise.

As the arms are rotated upward, the pivot brackets 51 secured at the forward end of each exercise arm rotate upwardly about pivot axes 54L and 54R, respectively, simultaneously pivoting the ends of extended plates 55 downwards and pushing drive links 56 downward. This in turn forces the forward end of user support base strut 29 to rotate downward about user support pivot axis 32 while the rear end rotates upward, moving the seat pad into a forwardly inclined position as illustrated in FIGS. 12B, 13B and 14B, and in dotted outline in FIG. 15. As the forward end of the base strut rotates downward, it pulls on the cable 41 connected to anchor 40, lifting the weights in weight stack 16 linked to the cable to provide a selected amount of exercise resistance. As noted above, the user's upper torso is upright or substantially upright at the start of the exercise. As the seat pad 28 rotates forward during the exercise, the user's torso also rotates forward through around sixteen degrees. The sixteen degree shift of the body angle through the lift alters the demand on the deltoid muscle to shift from forward to rear which provides a greater range of muscle engagement compared to a stationary machine. The more forward position of the body at the top of the exercise movement puts the user in a better power position and improves the body's ability to manage the weight being lifted. Thus, at the start of the exercise, the forward part of the user's deltoid muscle is activated, while the rear of the user's deltoid muscle is activated during the exercise as they rotate their arms outward and upward to the end position while their body moves forward.

In lateral deltoid exercise machine 10 of FIGS. 1 to 15, the vertical gravitational center line of the user support extending through pivot axis 32 is in front of the user's torso in the start position and extends through the user's torso in the dotted line end position of FIG. 15, and part of the user's weight is on each side of the gravitational center line in both the start and end position. This helps to keep the exercise resistance more uniform throughout the movement and reduces resistance drop off. The combined movement of the user support and exercise arms provides a safer, more natural feeling exercise motion that constantly adjusts the position of the user during the exercise to maintain proper alignment between the parts throughout the exercise. As can be seen by comparison of the solid and dotted line positions of the user's arms in FIG. 15, the arms do not move forward with the upper torso of the user's body, since the exercise arms are pivoted to the stationary main frame upright 19 and only rotate outward and upward, providing a greater range of deltoid muscle involvement in the exercise as compared with the stationary lateral deltoid exercise.

The rotating swivel link 36 at the forward end of the user support which links the user support to the exercise arms allows a bilateral exercise movement, meaning that one exercise arm can be lifted at a time, rather than lifting both exercise arms simultaneously. If one exercise arm is lifted instead of two, the user support rotates through half the distance or angle through which it rotates when both arms are lifted together, and half the resistance is provided. Using both arms simultaneously provides full resistance and results in forward rotation of the user support through sixteen degrees, as illustrated in FIG. 15. However, if only one exercise arm is lifted, such as the right hand exercise arm, the right hand drive link 56 is pushed downwards, causing the swivel link 36 to rotate about the pivot axis defined by post 38 rotating in sleeve 35. The articulating or universal swivel joint 57 allows the lower end of the left hand drive link to rotate inward to accommodate swiveling of link 36, pushing down the forward end of the base strut and rotating the user support through half the distance as compared to lifting both arms, or around eight degrees in the illustrated embodiment. In an alternative embodiment, swivel link 36 may be replaced with a rigid link if only unilateral exercise arm movement is desired.

Although the pivot mount assembly or frame 37 is shown with an open front in the drawings, it may be a pivot housing with the open front closed with a cover plate in an alternative embodiment, and the pivot links and drive links may also enclosed in an outer housing or shield if desired, with openings to allow for the arm and user base strut movement between exercise start and end positions.

Figure 16:
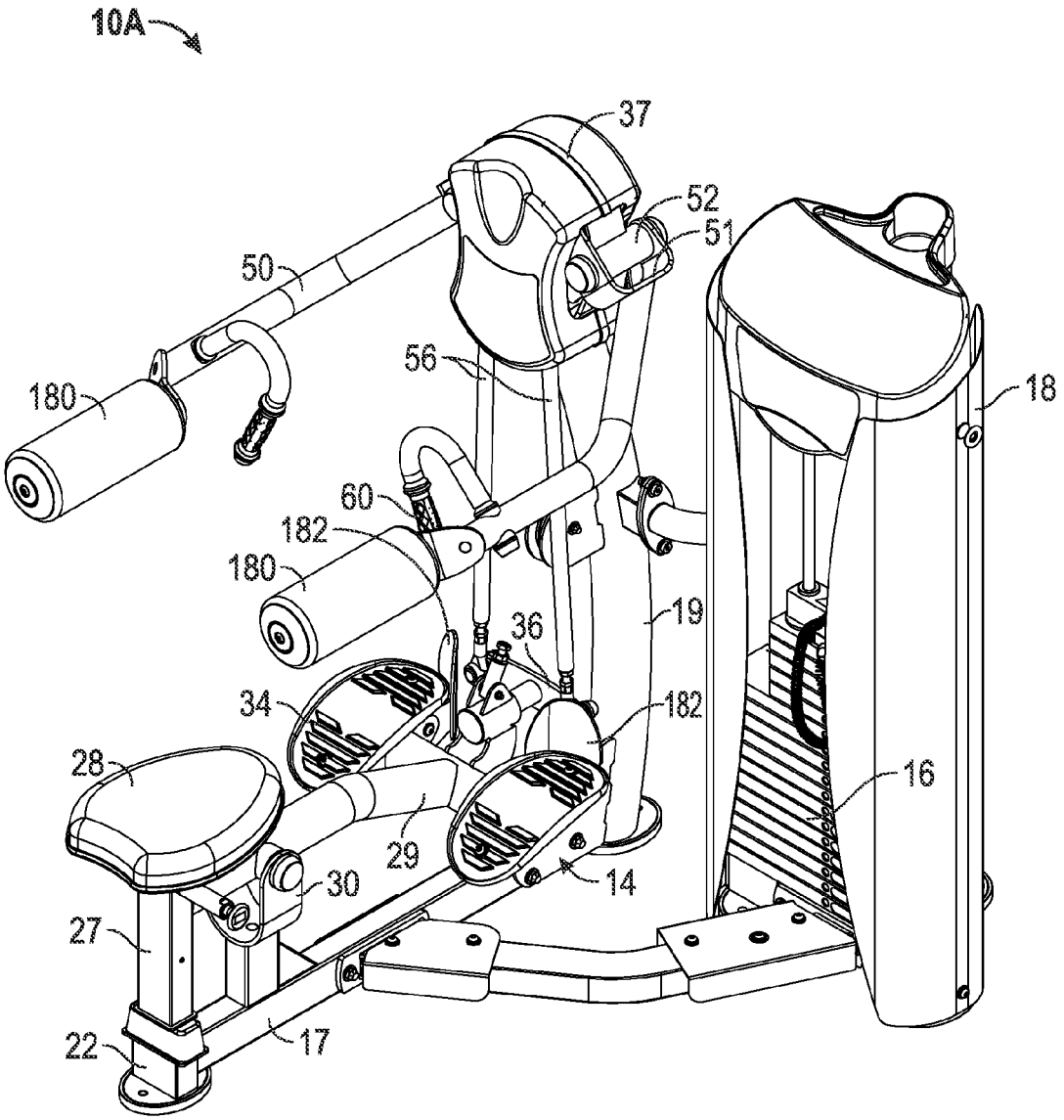
FIG. 16 is a perspective view illustrating a modification of the exercise machine of FIGS. 1-15, with the machine in a start position for a lateral deltoid exercise.

FIG. 16 illustrates a lateral deltoid exercise machine 10A similar to the machine of FIGS. 1 to 15 but with some modifications. In FIG. 16, the arm pads 58 of FIGS. 1 to 15 are replaced by roller pads 180 mounted on projecting portions of the exercise arms 50. Additionally, toe guards 182 are provided at the forward ends of footrests 34. The pivot housing 37 is also larger than in FIGS. 1 to 15 and modified in shape, and is shown in FIG. 16 with the front cover in place. The pivot connection between plates 55 and the upper ends of drive links 56 inside housing 37 is identical to the linkage shown in FIGS. 1 to 15. As in the first embodiment, the inner ends of extended side plates 55 extend through slots in the side walls of the housing to allow for pivotal movement of the bracket 51 between the start and end positions which are identical to the positions shown in FIGS. 12A and 12B. Machine 10A is otherwise identical to the machine of FIGS. 1 to 15, and like reference numbers are used for like parts as appropriate.

FIGS. 17 to 27 illustrate a second embodiment of a lateral deltoid exercise machine 110, while FIGS. 28A to 32 illustrate a user in an exercise position on the machine and performing a deltoid exercise. This embodiment is similar to the first embodiment but has a user support with a back rest, and the user faces in the opposite direction while performing the exercise. The connecting linkage in this embodiment is also different, and comprises a cable and pulley linkage instead of drive links 56 as in the previous embodiment. Other differences are the position of the weight stack and the movement of the user support during an exercise, as explained in more detail below.

Deltoid exercise machine 110 has a user support 112 which is pivotally mounted on a stationary main frame 114 and linked to a moving user engagement device or exercise arm assembly 115 via connecting linkage 111 (FIG. 27), so that movement of the user engagement device during an exercise is translated into rotation of the user support about its pivot axis, as described in more detail below. An exercise resistance or load is associated with the exercise arms, user support, or connecting linkage for resisting the deltoid exercise movement. In the illustrated embodiment, the exercises resistance comprises a selectorized weight stack 116 in weight stack housing 118. Other types of exercise resistance may be linked to any of the moving parts of the machine in other embodiments, such as weight plates, rubber bands, flex rods, or hydraulic, pneumatic, or electro-magnetic resistance or loads.

Figure 19:
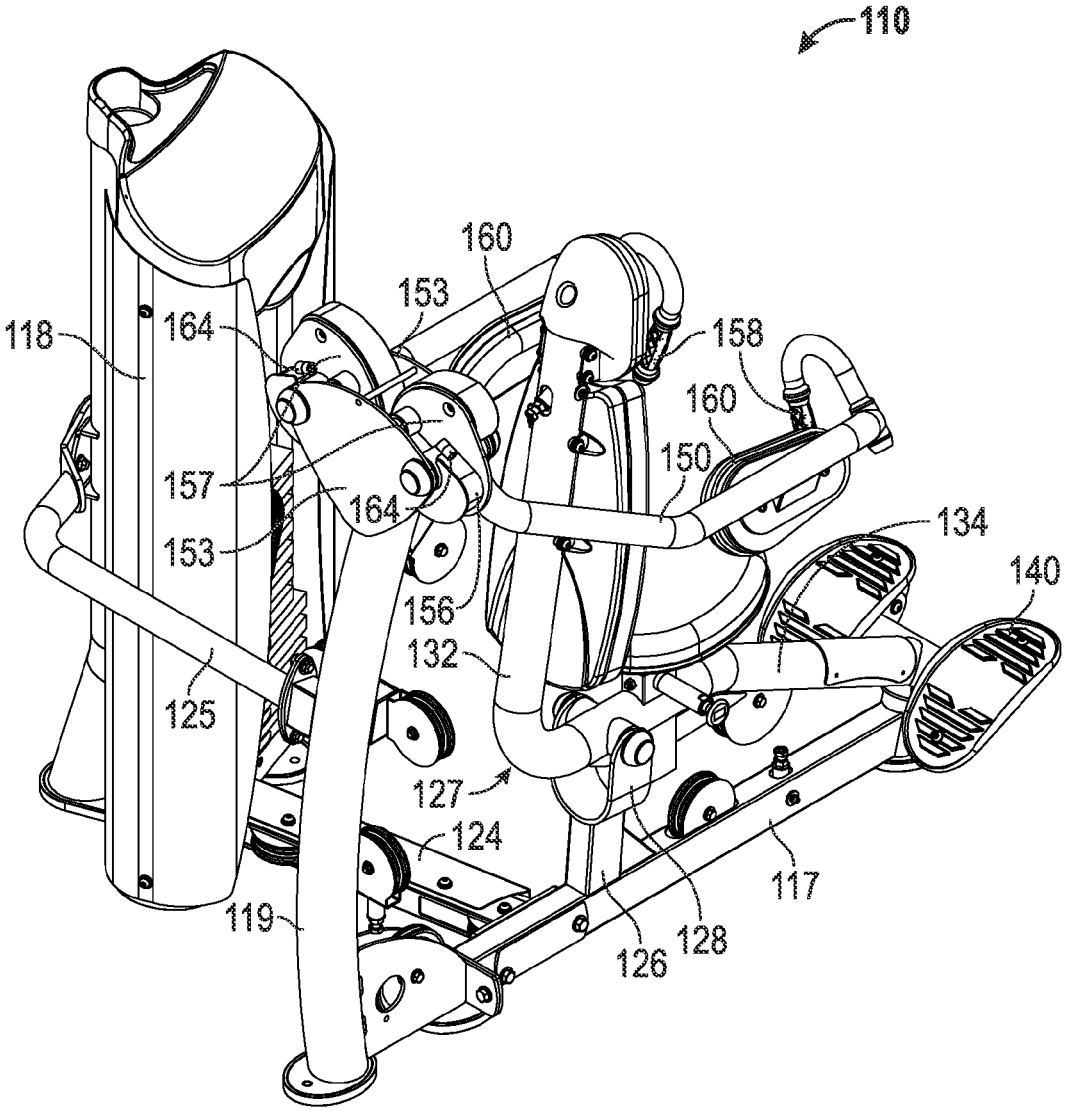
FIG. 19 is a rear perspective view of the machine in the start position of FIG. 17.

The stationary main frame 114 has a floor engaging base strut 117 and a rear upright 119 which curves forward towards the upper end. The base strut 117 has a ground engaging foot 120 at its forward end, and a short, forwardly inclined stand off post 122 projects upward from foot 120. A pivot support post 126 extends upwardly from base strut 117 at a location spaced forward from rear upright 119. A transverse strut or cable guide tube 124 extends between the base strut and the weight stack housing 118. A support strut 125 extends from a raised position on rear upright 119 to the weight stack housing 118 and is secured to the rear of the housing, as illustrated in FIG. 19. The connection between the weight stack housing and main frame may be reversible so that the weight stack can be mounted on either side of the housing.

The user support 112 has a generally L-shaped support frame 127 which is pivotally mounted on a pivot bracket 128 at the upper end of pivot support post 126 via pivot 129 for rotation about user support pivot axis 130. The user support frame 127 has an upright portion 132 which is slightly forwardly inclined in the rest or start position of FIG. 21, and a base portion 134 which projects forward from the lower end of upright portion 132. A seat pad 135 is adjustably mounted on base 134 adjacent upright 132 via telescopic adjuster mechanism 136, and a back pad 138 and head rest 139 are mounted on upright portion 132. Footrests 140 are mounted on a cross bar at the forward end of base portion 134.

Figure 17:
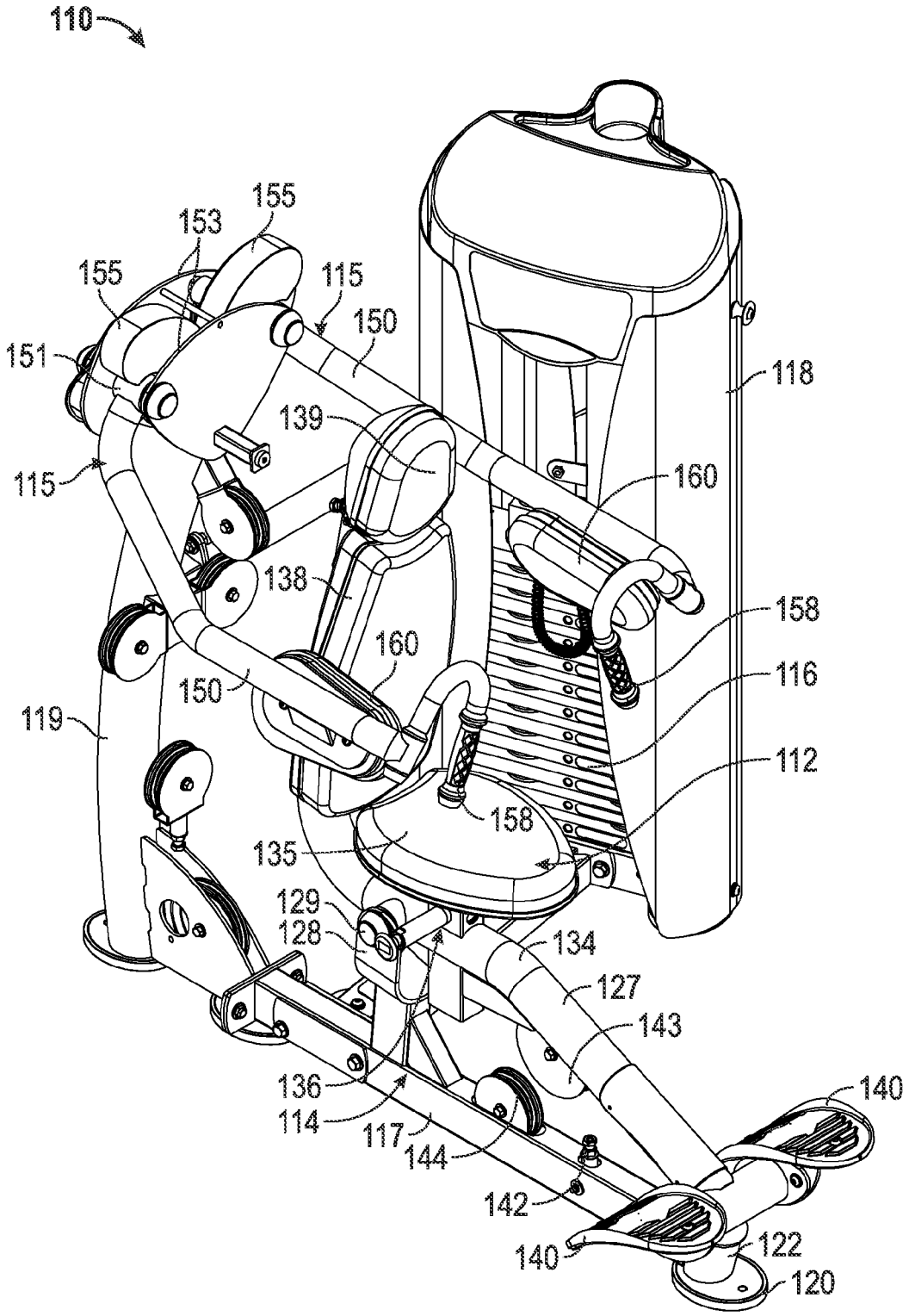
FIG. 17 is a perspective view of a lateral deltoid exercise machine according to a second embodiment, with the machine in a start position for a deltoid exercise.
Figure 18:
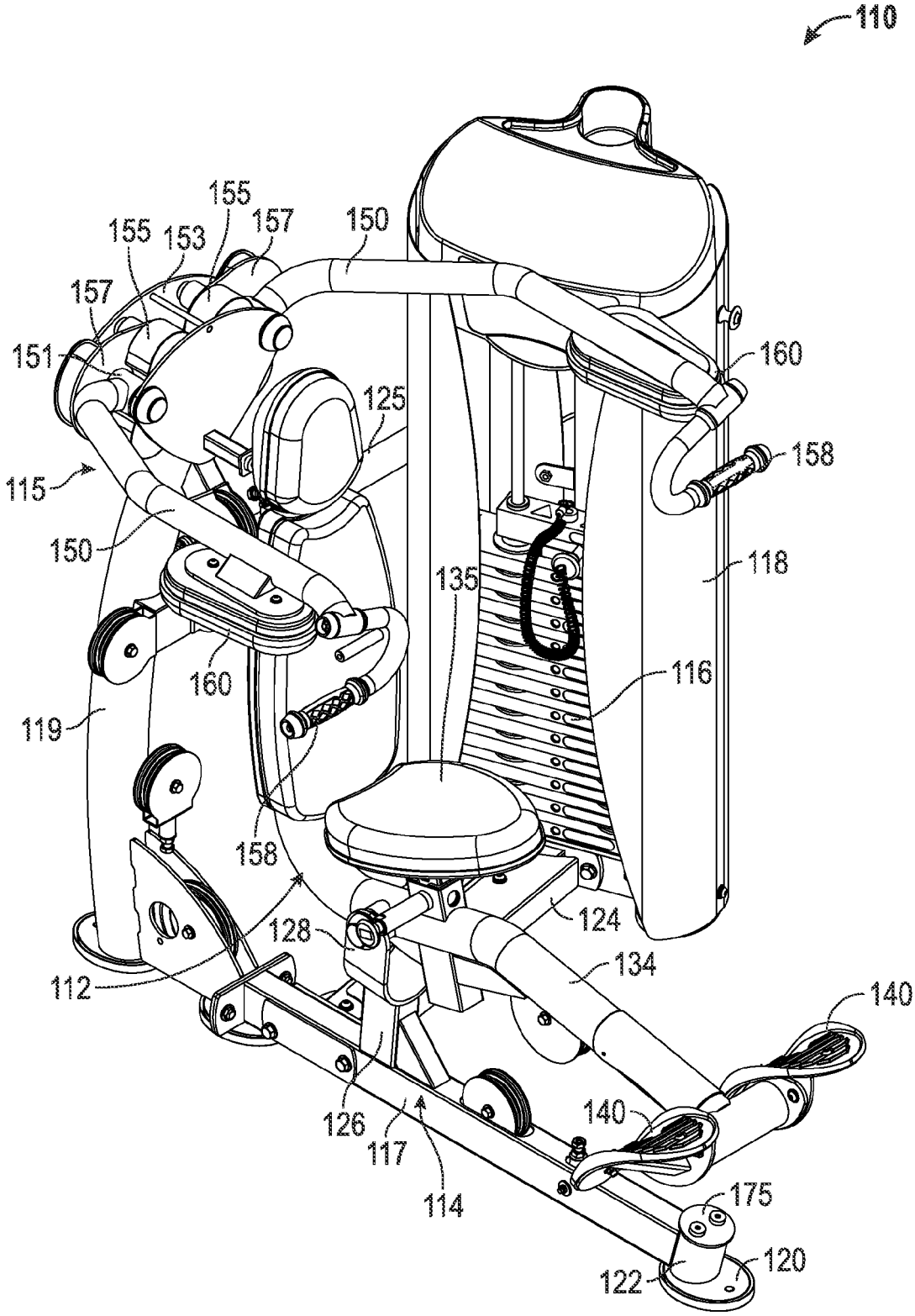
FIG. 18 is a front perspective view similar to FIG. 17 but showing the exercise arms in an end position for a deltoid exercise.
Figure 27:
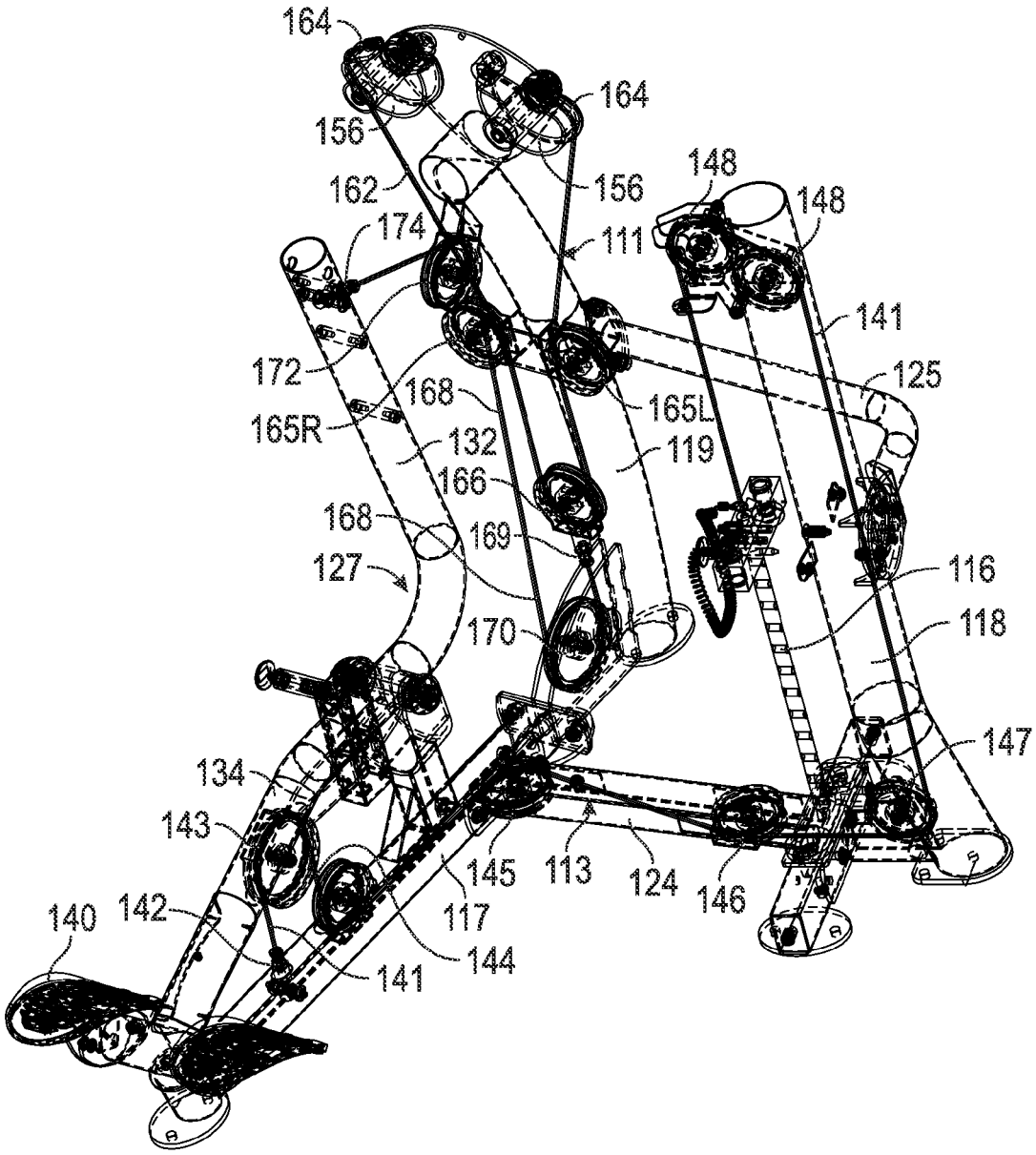
FIG. 27 is a broken away, perspective view of the machine of FIGS. 17 to 26 illustrating the cable routing between the exercise arm assembly and user support and between the user support and exercise resistance.

The user support frame 127 is linked to selected weights in weight stack 116 via a cable and pulley assembly 113 in a standard manner, as best illustrated in FIG. 27, so as to provide resistance to rotation of the support frame 127 between the start and end positions of FIGS. 17 and 18. The cables of the cable and pulley assembly 113 are only shown in FIG. 27, and are omitted from the other drawings for clarity. A cable 141 extends from base frame cable anchor 142 on base strut 117, around a first pulley 143 on the base portion 134 of the user support frame, and then around a second pulley 144 on the base 117 of the main frame which is spaced to the rear of anchor 142. Cable 141 then extends through the tubular base strut 117 and into the cable guide tube or strut 124 between the base strut 117 and weight stack housing 18, around additional guide pulleys 145, 146 in the guide tube and an upwardly directed guide pulley 147 in the base of housing 118. The cable 141 is then guided around guide pulleys 148 at the top of housing 118, and extends downward for connection to a selected number of weights in weight stack 116 in the standard manner.

Figure 20:
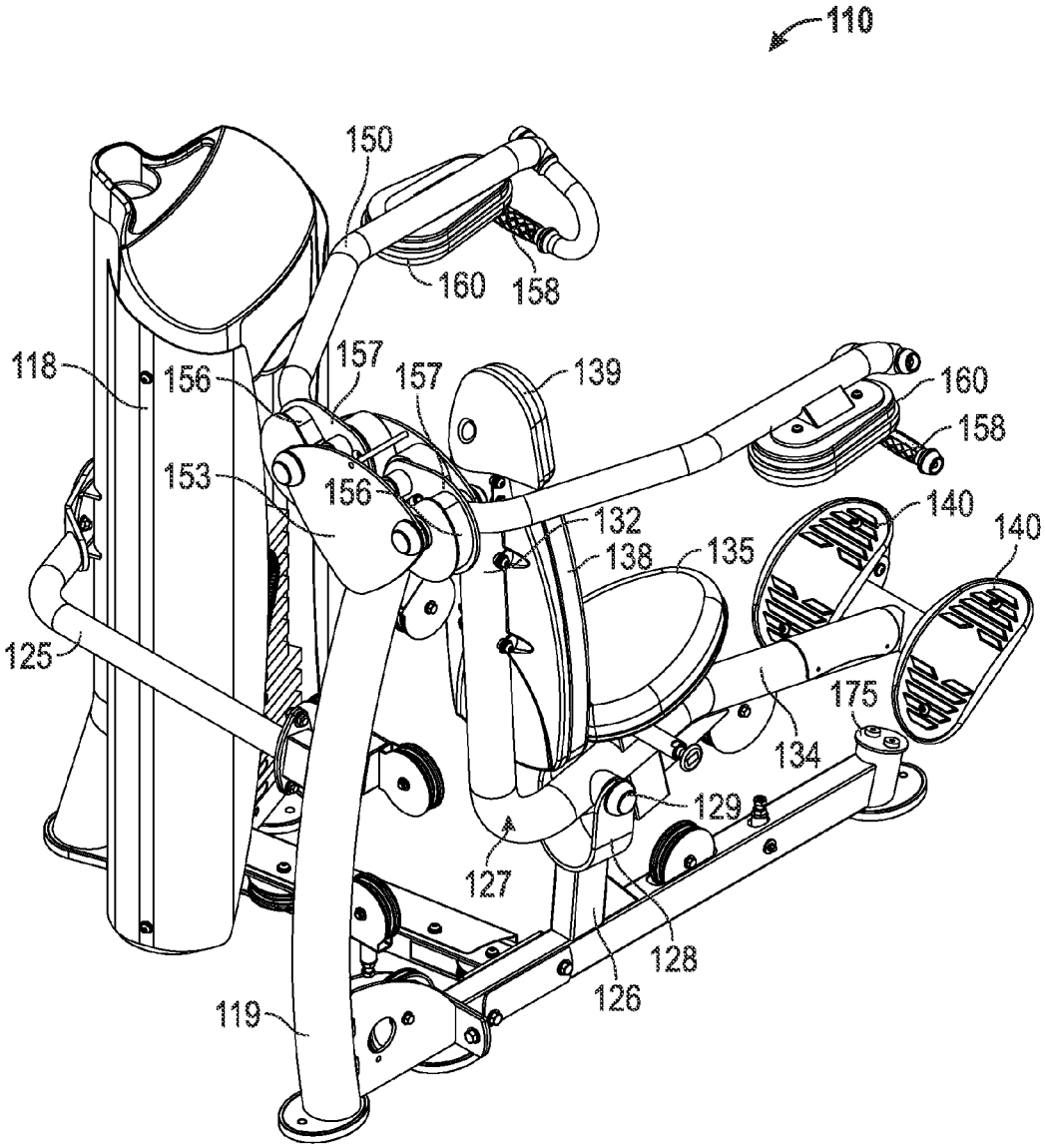
FIG. 20 is a rear perspective view of the machine in the end position of FIG. 18.
Figure 25:
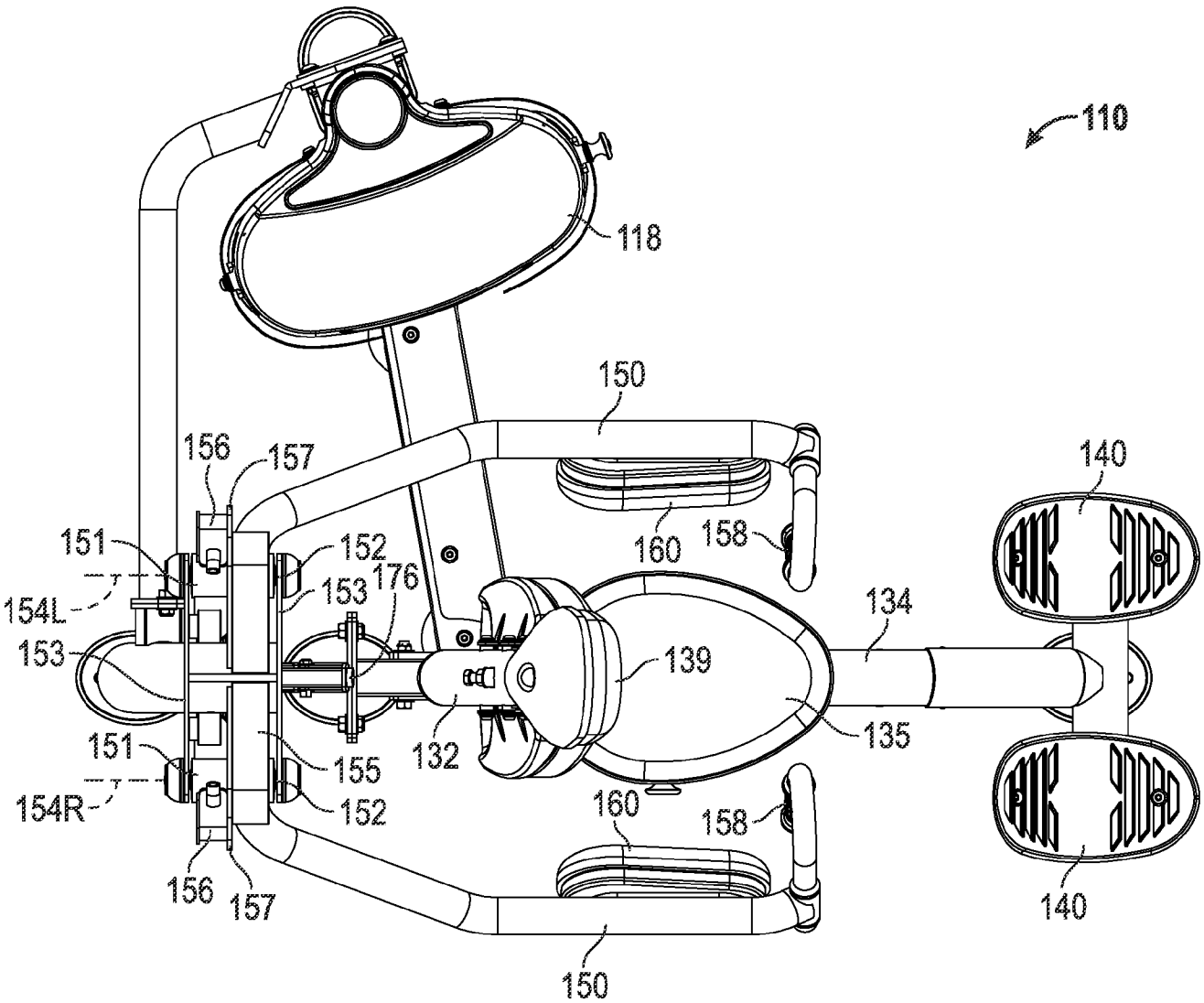
FIG. 25 is a top plan view of the machine in the start position of FIG. 17.
Figure 26:
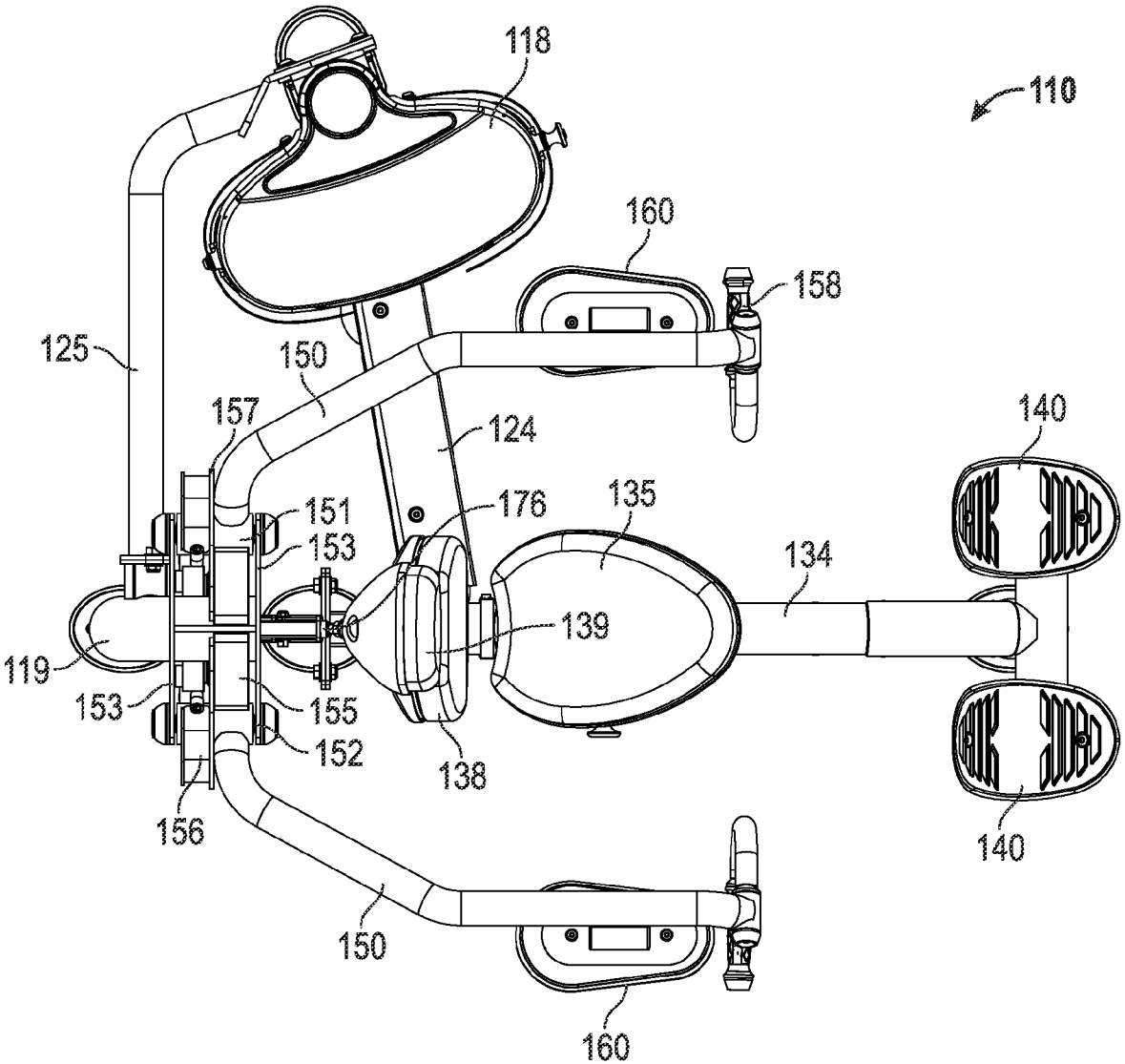
FIG. 26 is a top plan view of the machine in the end position of FIG. 18.

The exercise arm assembly 115 comprises left and right pivoted exercise arms 150 configured for engagement by the user's forearms and hands when seated on the user support. As best illustrated in FIGS. 17 and 25, exercise arms 150 are each pivotally mounted at their rear ends via pivot sleeves 151 rotatably engaged on left and right arm pivots 152 extending between a pair of pivot support brackets 153 mounted at the upper end of rear upright 119 of the stationary main frame and defining spaced, horizontal arm pivot axes 154L and 154R (FIG. 25). Counterweights 155 attached to the pivot sleeves return the arms 150 to the start or rest position of FIGS. 17, 19, 21 and 23 when released by a user. A respective arm cam 156 is also attached to each pivot sleeve via mounting plate 157, as best illustrated in FIGS. 19 and 20.

Figure 23:
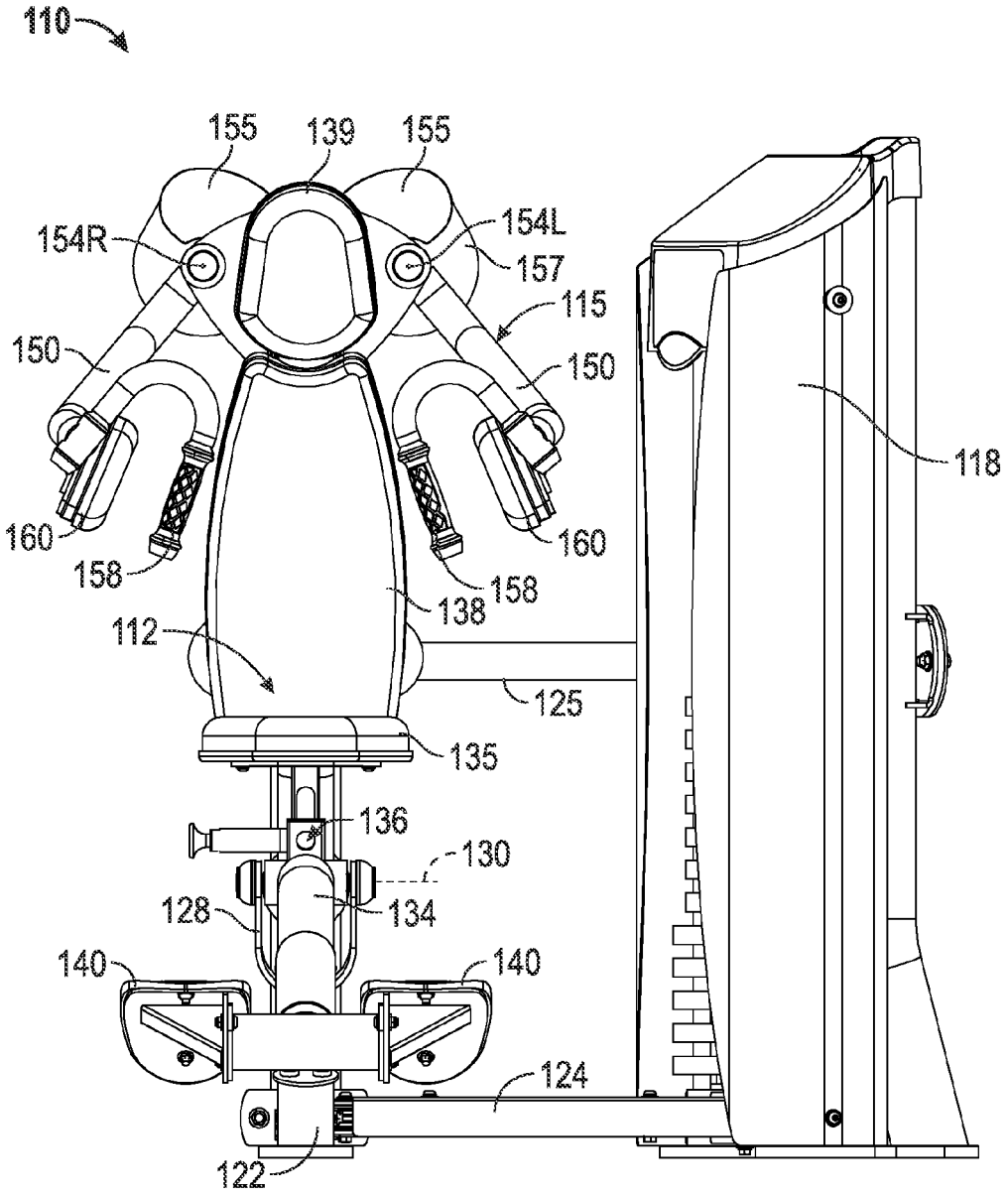
FIG. 23 is a front elevation view of the machine in the start position of FIGS. 17, 19 and 22.
Figure 24:
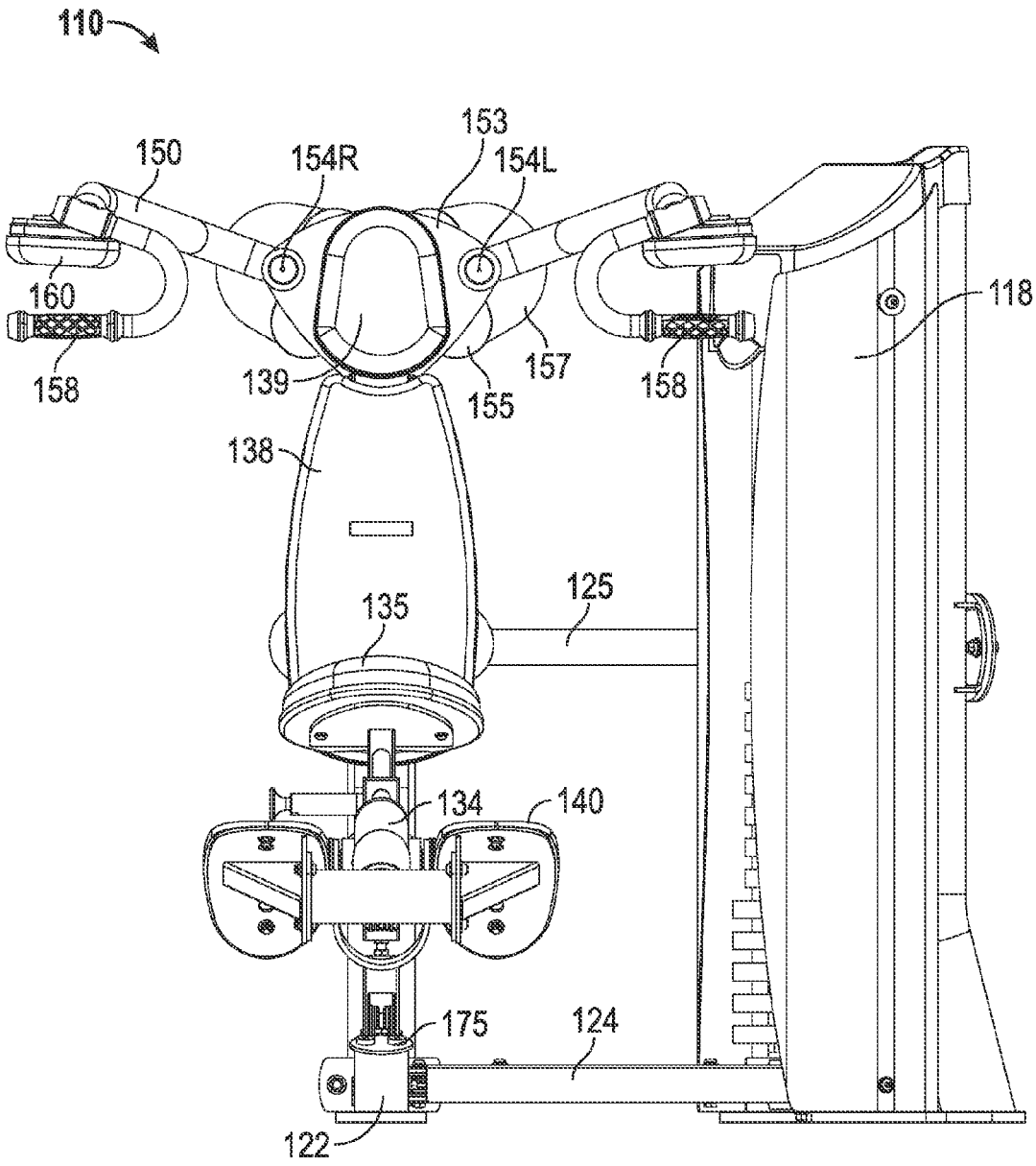
FIG. 24 is a front elevation view of the machine in the end position of FIGS. 18, 20 and 22.
Figure 30A:
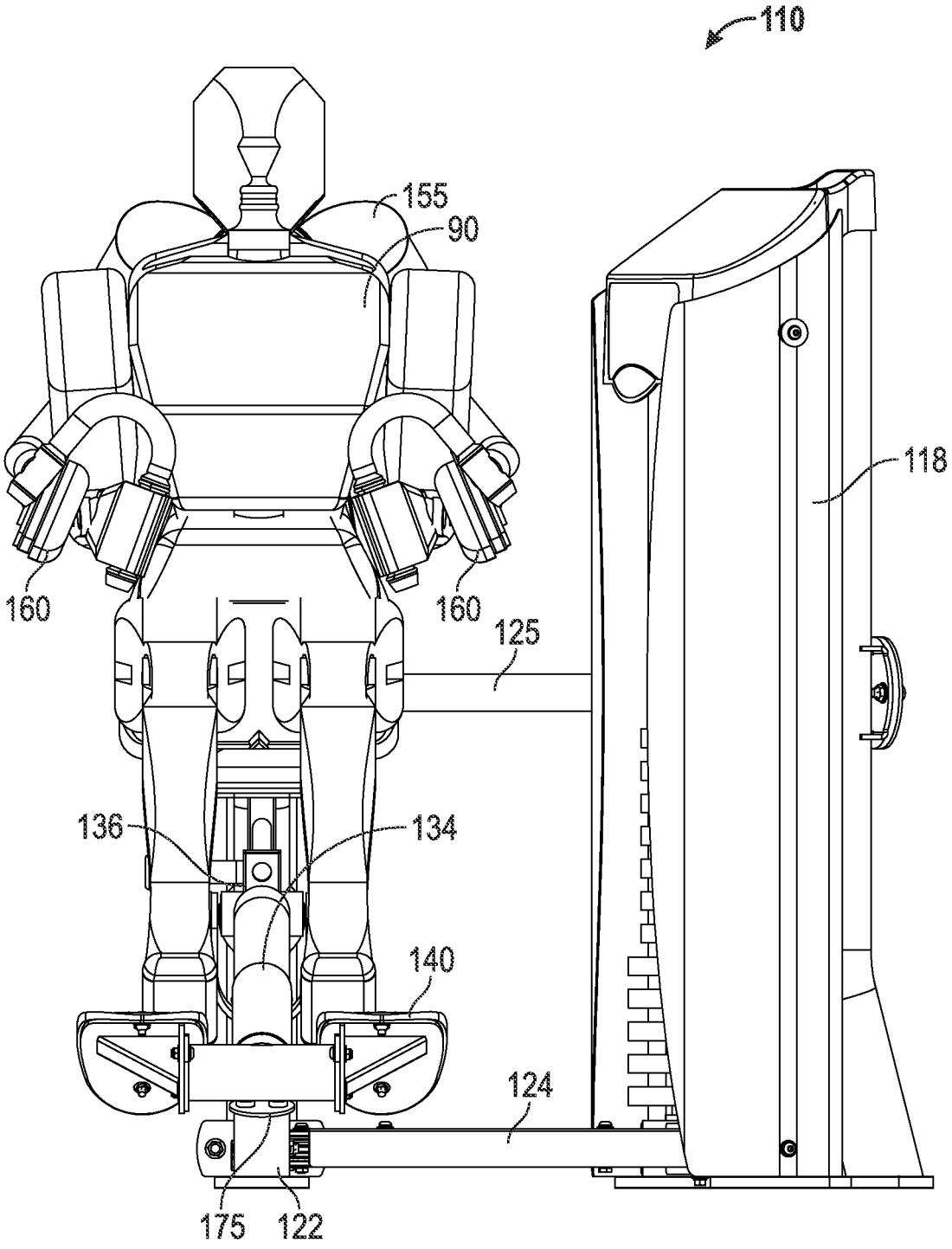
FIG. 30A is a front elevation view illustrating the machine and user in the start position of FIGS. 28A and 29A.

Each arm 150 has a handle or grip 158 at its forward end configured for gripping by a user 90 with their palms facing inward and slightly downward in the exercise start position, as best illustrated in the front elevation views of FIGS. 23 and 30A. A lower arm or forearm pad 160 is mounted on each exercise arm 150 at a location spaced rearward from handle 158 and is positioned for engagement by the forearm 92 of user 90 when the user grips handle 158, as best illustrated in FIGS. 28A, 28B, 30A and 30B. Each forearm pad 160 is positioned on the respective exercise arm so that it faces generally inwardly towards the opposite forearm pad and is inclined outwardly from the upper to the lower end of the pad in the start position of FIG. 23.

The connecting linkage 111 which translates movement of the exercise arms 150 into rocking movement of the user support comprises a cable and pulley linkage which is illustrated in detail in FIG. 27. Parts of machine 110 are omitted in FIG. 27 to reveal the cables of linkage 111. The cables of linkage 111 are omitted for clarity in the remaining drawings. A first cable 162 extends from a cable anchor 164 on the right arm cam 156, around the curved outer portion of the cam, and downwardly around part of a first guide pulley 165R on upright 119, around a floating pulley 166, then upwardly from floating pulley 166 around a second guide pulley 165L on upright 119 adjacent pulley 165R, and finally around the curved outer portion of the left arm cam 156 to cable anchor 164 on that cam. A second cable 168 extends from an anchor 169 on the housing of floating pulley 166, downwardly around a pulley 170 on the stationary frame at the junction between base strut 117 and upright 119, upwardly and around a guide pulley 172 secured to an upper portion of upright 119 below the pivot brackets 153, and finally connecting to an anchor 174 on the rear of the upright 132 of user support frame 127.

Figure 21:
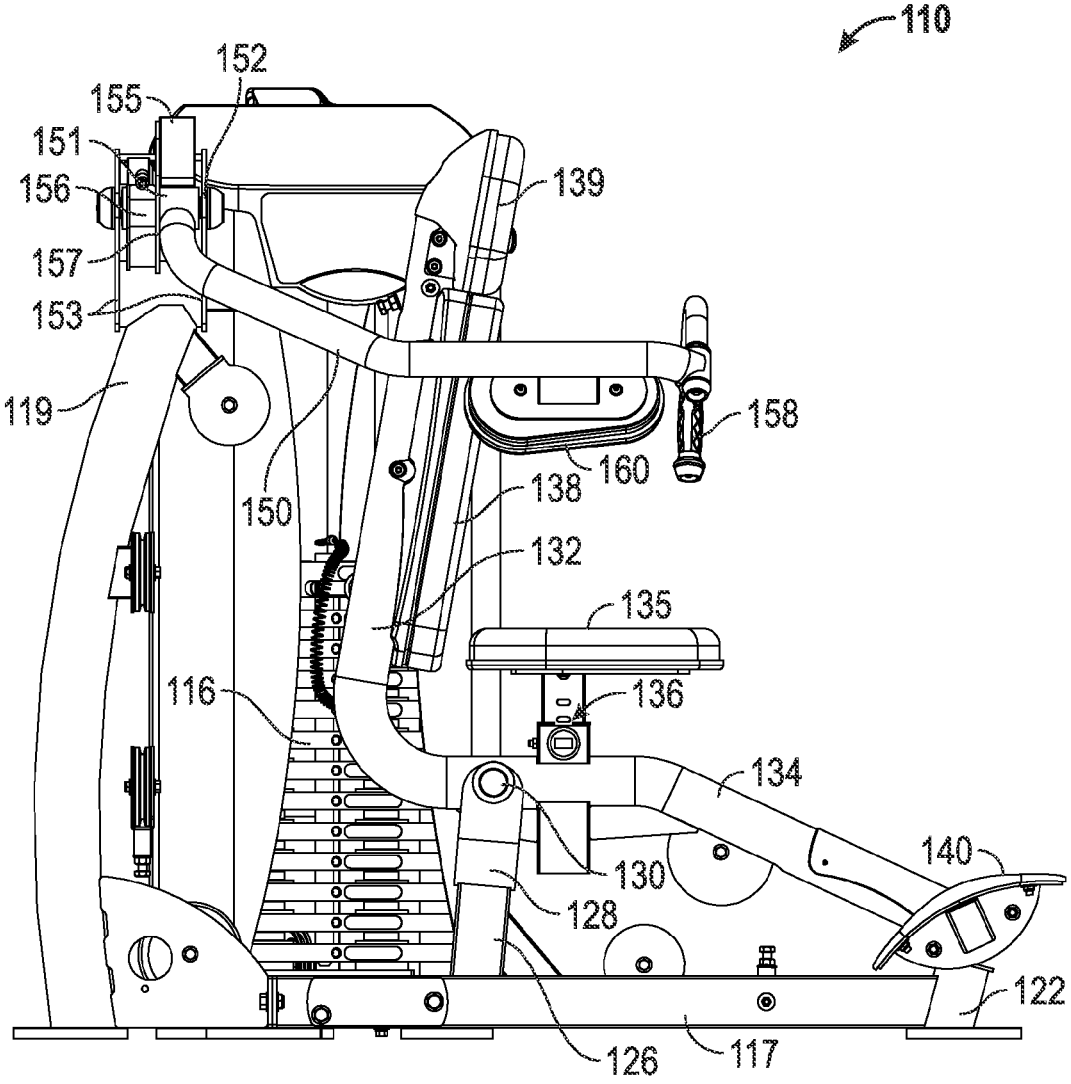
FIG. 21 is a side elevation view of the machine in the start position of FIGS. 17 and 19.
Figure 22:
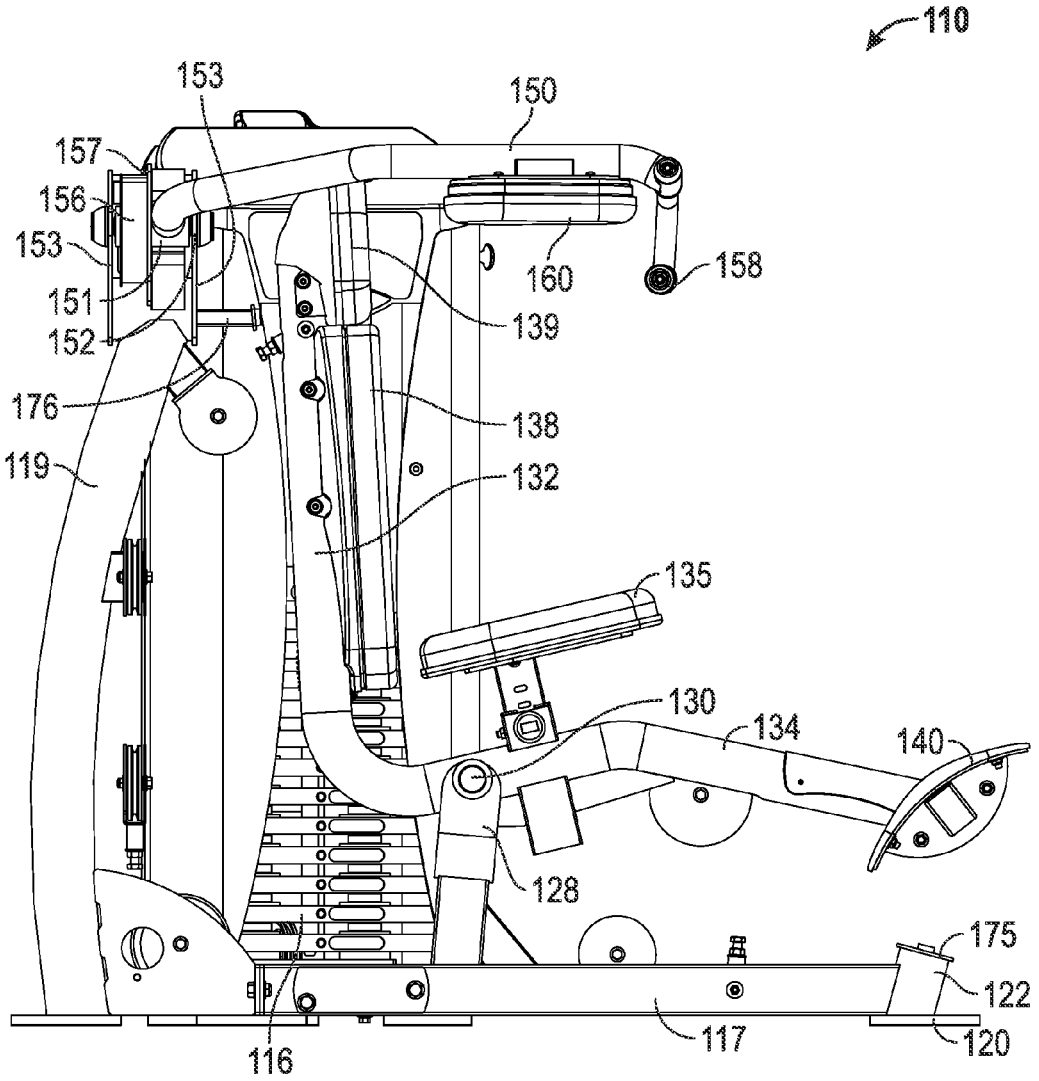
FIG. 22 is a side elevation view of the machine in the end position of FIGS. 18 and 20.

The user support and exercise arm pivot mounts together with the connecting linkage define predetermined movement paths of the exercise arms and user support during an exercise. FIGS. 17, 19, 21, 23 and 25 illustrate the start or rest position of the lateral deltoid machine 110, while FIGS. 18, 20, 22, 24 and 26 illustrate an exercise end position. As best illustrated in FIGS. 17, 21 and 23, the cross bar at the forward end of the base 134 of the user support frame rests on a stop pad 175 at the upper end of stand off post 122 in the rest or exercise start position. The rear upright 132 of the user support frame rests against a stand off post 176 projecting from forward pivot bracket 153 of the exercise arm assembly in the exercise end position of FIGS. 20, 22 and 26. An exerciser may choose to end the exercise before this stop position is reached, if desired. As illustrated in FIG. 21, the upright 132 and back pad 138 of the user support frame are angled forward at an angle of around ten degrees in the rest or start position, and are angled rearward at an angle of around five degrees to the vertical orientation in the end or stop position of FIG. 22.

Figure 32:
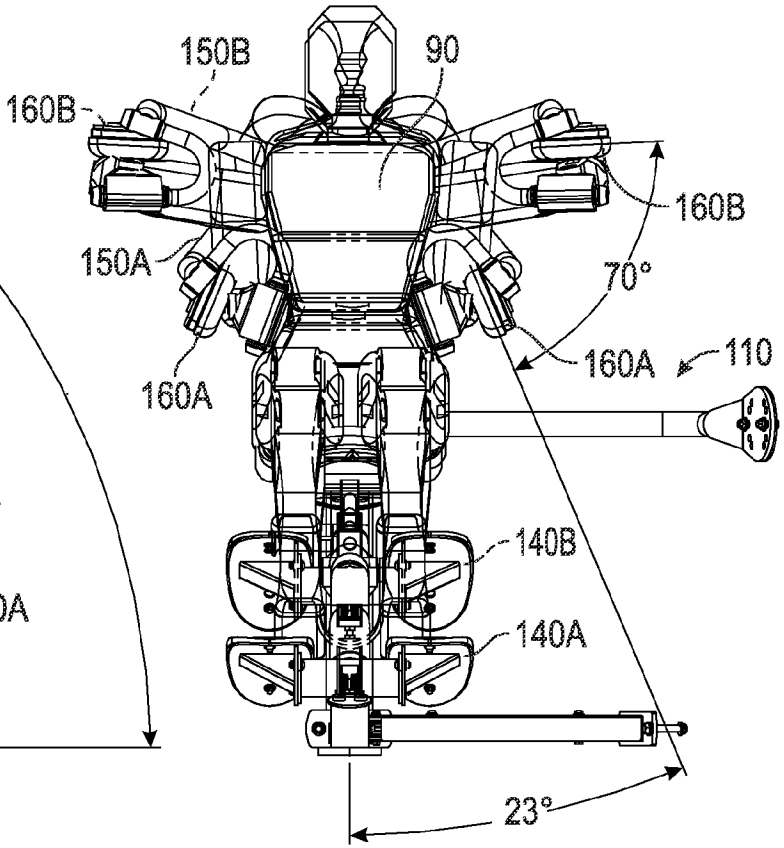
FIG. 32 is a front elevation view illustrating the two positions of FIGS. 30A and 30B superimposed.
Figure 31:
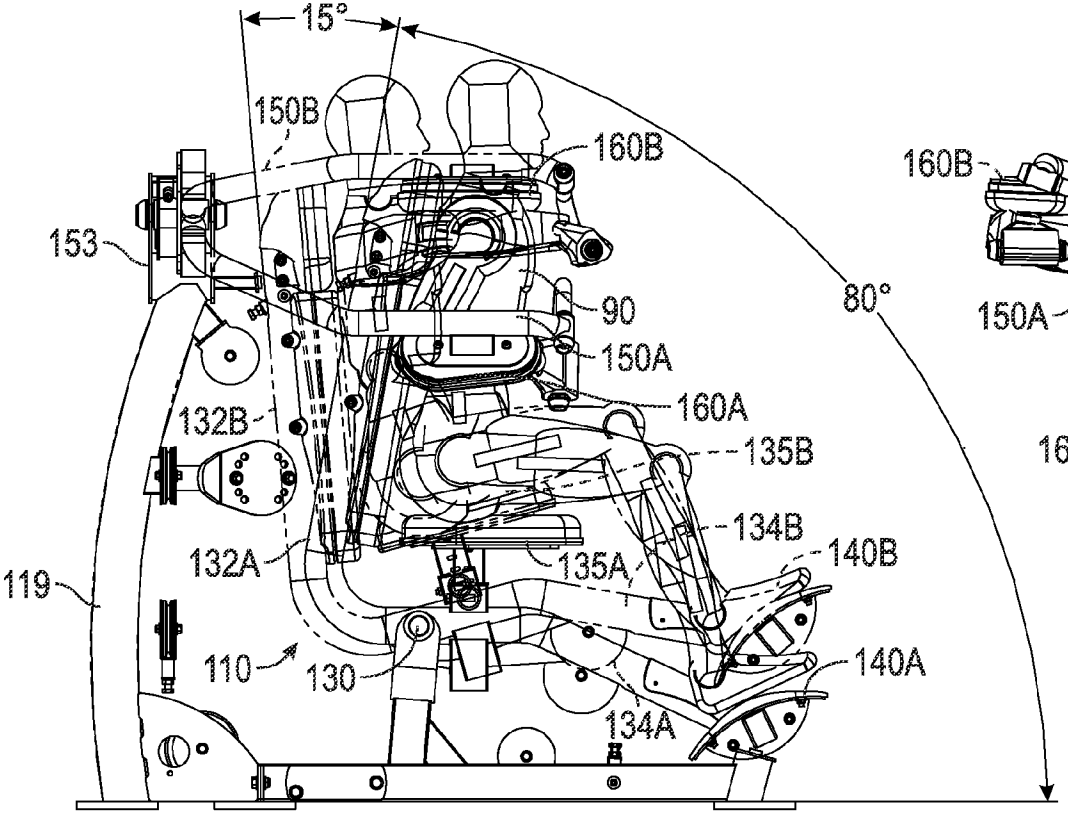
FIG. 31 is a side elevation view illustrating the two positions of FIGS. 29A and 29B superimposed, to illustrate the movements of the moving parts of the machine during an exercise.

The exercise arms each rotate outward and upward between the start position and the end position, while the connecting linkage 111 simultaneously rotates the user support between the start and end positions as described above. The start and end positions of the user support and exercise arms are superimposed in FIGS. 31 and 32, respectively, with the start position in solid outline and all reference numbers ending with the letter A, and the end position in dotted outline and corresponding reference numbers ending with the letter B. This shows that the user support rotates through an angle of fifteen degrees around the pivot axis 130 between the start position and end positions shown in solid and dotted outline, respectively, while each exercise arm 150 rotates about its respective pivot axis 154R and 154L, respectively, between a generally forwardly extending orientation adjacent opposite sides of the seat in the start position (see FIGS. 22, 26 and 32) and a raised, forwardly extending orientation spaced upwardly and outwardly from the start position in the end position (see FIGS. 23, 27, and 32). Each arm rotates through an angle of around 70 degrees between the start and end position, as indicated in FIG. 32. As also illustrated in FIG. 32, each lower arm or forearm pad 160 is angled outwardly at an angle of around 23 degrees to the vertical orientation in the exercise start position 160A, and is directed downwards in a substantially horizontal orientation in the exercise end position 160B.

Figure 28A:
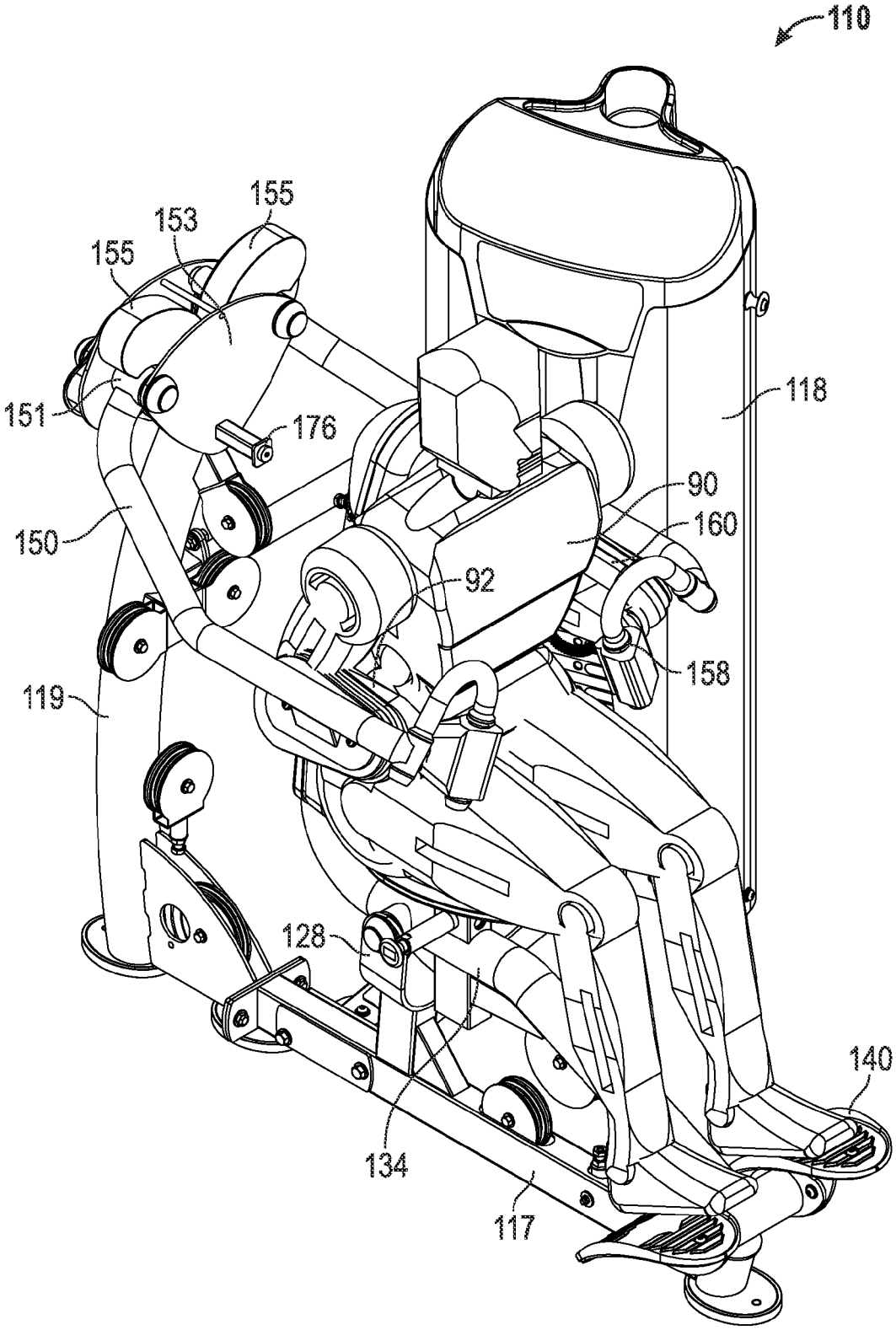
FIG. 28A is a front perspective view of the lateral deltoid machine in the start position of FIG. 17 with a user seated on the rocking user support and engaging the exercise arms.
Figure 28B:
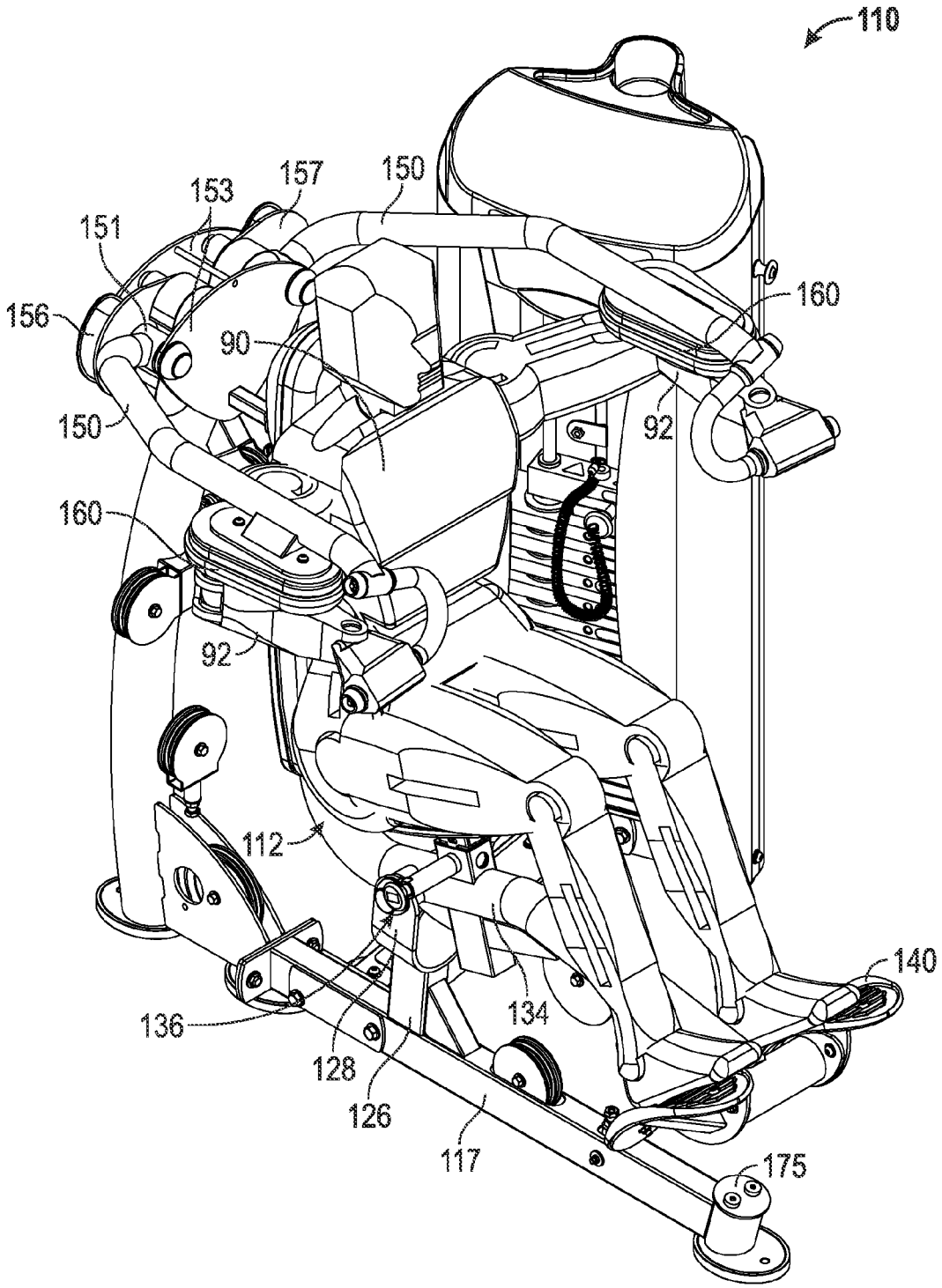
FIG. 28B is a front perspective view similar to FIG. 28A but showing the machine and user in an end position for a deltoid exercise.
Figure 29A:
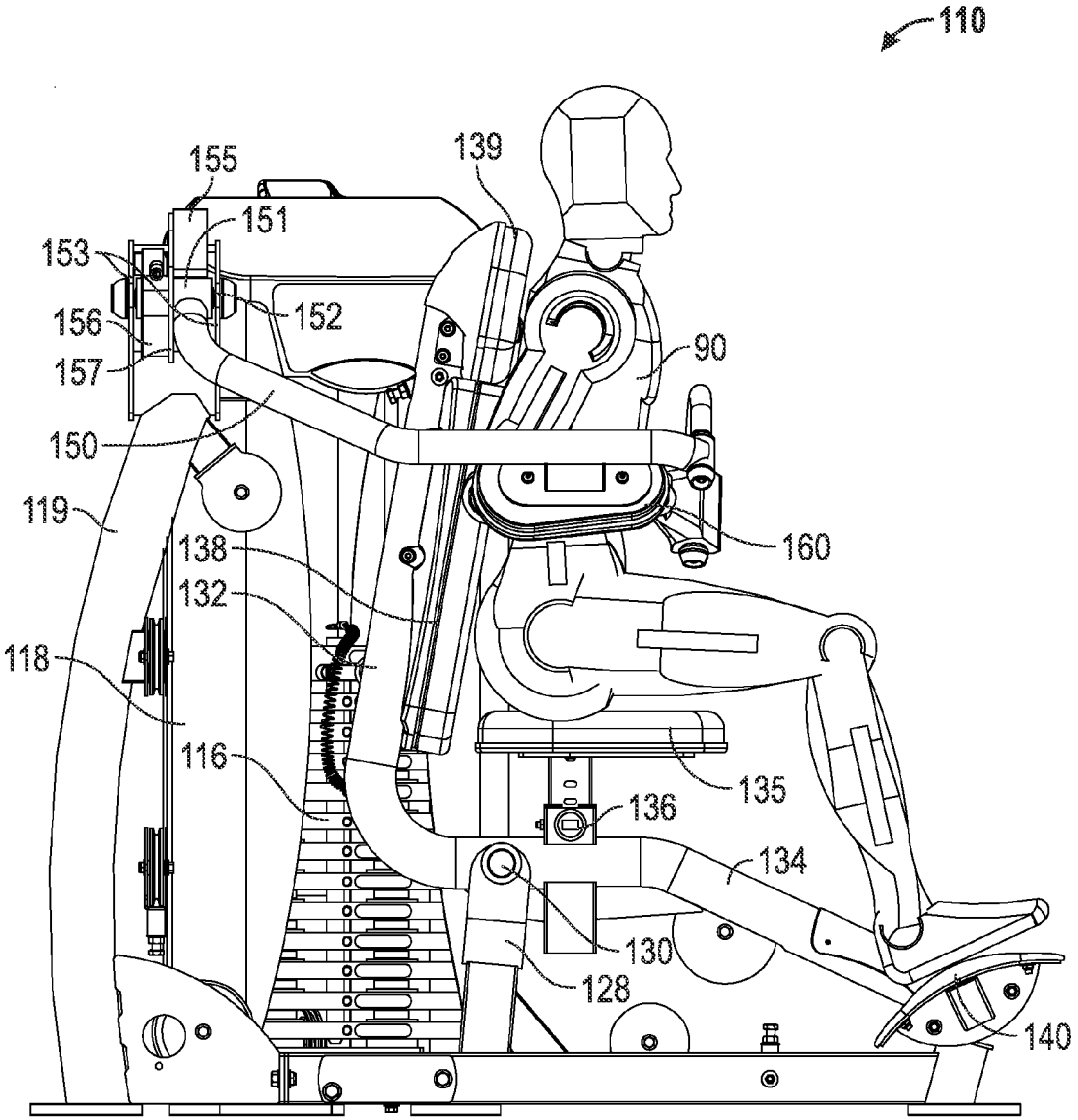
FIG. 29A is a side elevation view illustrating the machine and user in the start position of FIG. 28A.
Figure 29B:
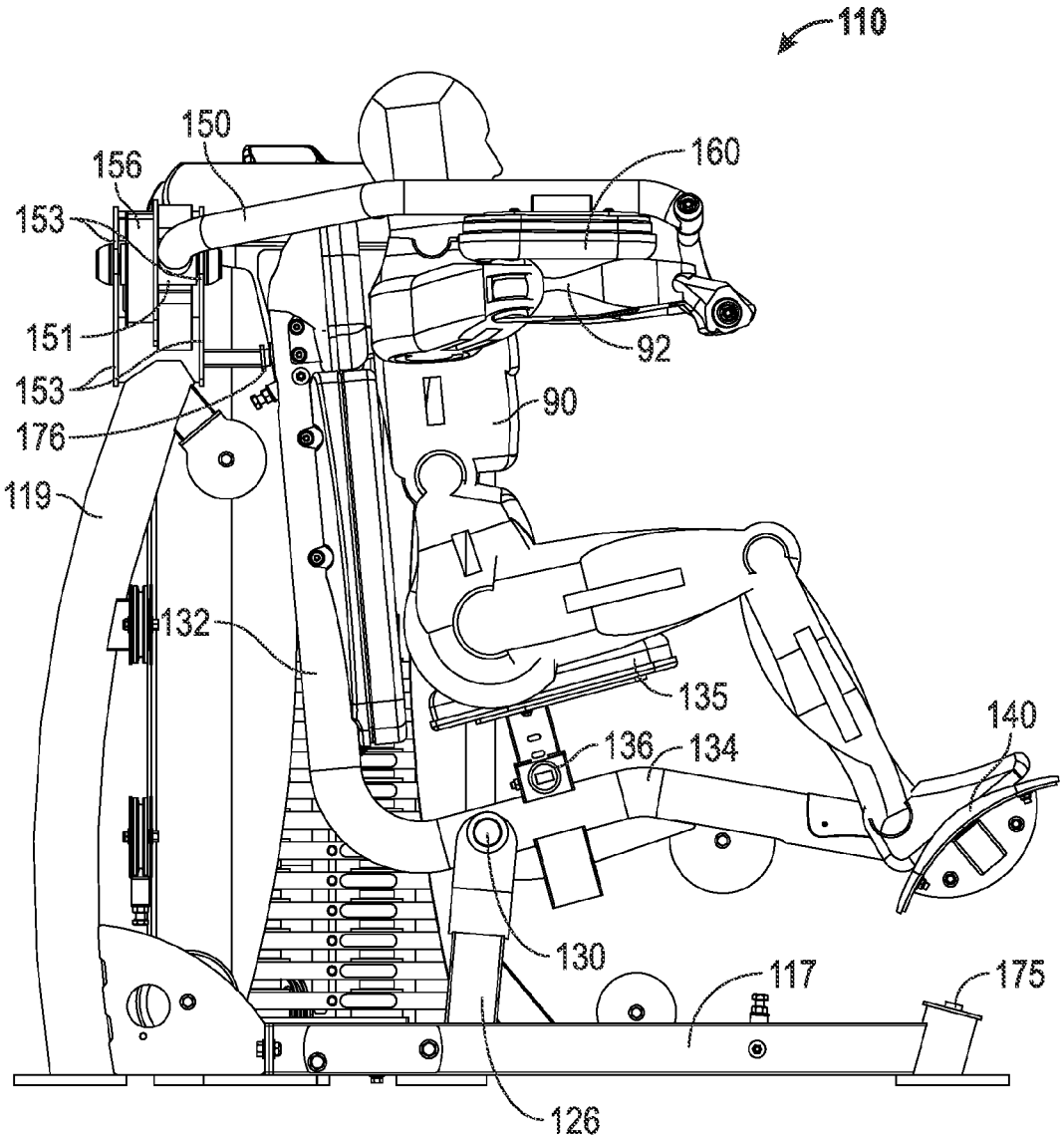
FIG. 29B is a side elevation view similar to FIG. 29A but showing the machine and user in the end position of FIG. 28B.
Figure 30B:
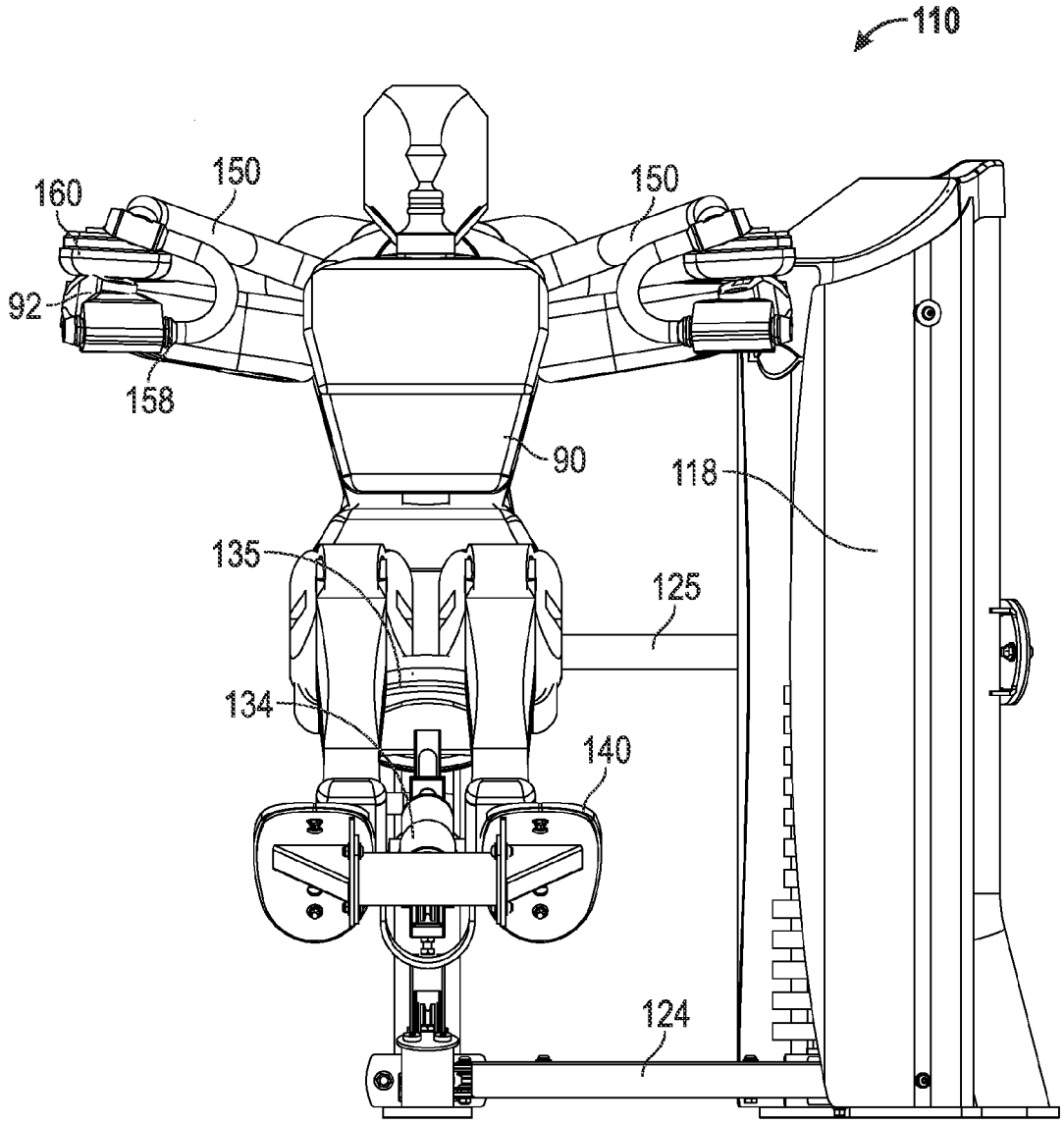
FIG. 30B is a front elevation view similar to FIG. 30A but showing the machine and user in the end position of FIGS. 28B and 29B.

FIGS. 28A to 30B illustrate a user 90 seated on the user support 112 and performing a lateral deltoid exercise. In order to use the lateral deltoid exercise machine 110, the user first sits on the seat pad 135 with their feet engaging footrests 140 and their back and head engaging back pad 138 and head pad 139, respectively, while the moving parts of the machine are in the exercise start or rest position of FIGS. 28A, 29A and 30A. The height of seat pad 135 may first be adjusted by the user as needed, using telescoping adjustment mechanism 136, so that the forearms 92 line up with the arm pads 160 and handles 158 when the forearm is bent forward at the elbow, as best illustrated in FIG. 28A. Once the seat is at the proper height, the user assumes a seated position with the feet placed on the footrests and the upper torso between the arm pads 160 of exercise arms 150. They then place the back of each forearm 92 against the respective arm pad 160 while grasping the handle 158 for stabilization. While the back rests against the back pad, the arms are then rotated upward and outward while pressing the forearms against the arm pads 160 until the arms extend straight out at the sides in the exercise end position, as indicated in FIG. 30B. The user then returns the arms to the starting position and repeats the exercise for the desired number of repetitions.

As the arms are rotated upward, they drive the cabling system of the connecting linkage 111 so as to force the user support 112 to rotate rearward about pivot 130. As the user support rotates rearward, it pulls on the cable 141 which is linked to the weight stack 116 to provide a selected amount of exercise resistance. As noted above, the user support upright 132 and associated back pad 138 are angled forward at an angle of around ten degrees in the exercise start position. This means that the user's upper torso is also angled ten degrees forward at the exercise start, as indicated in FIG. 30A. At this forward position, the rear of the user's deltoid muscle is activated as they start to rotate their arms outward and upward. As the arms continue to rotate upward through an angle of about 70 degrees to the end of the exercise, the upper torso with the back resting against the back pad rotates backward through around 15 degrees. However, the user's arms only rotate outwards and upwards, and do not follow the back pad rearward, since the exercise arms and handles are pivoted to the fixed upright 119 of the stationary main frame.

In the embodiment of FIGS. 17 to 32, the user support seat is rotated rearward as the exercise arms are rotated upward, and the user's arms do not follow the upper torso rearward with the user seat rotation. The shift between these body parts throughout the exercise alters the demand on the deltoid muscle to shift from the rear of the muscle forward, providing a greater range of muscle engagement during the exercise as compared to a deltoid machine with a stationary support. The result is a more natural feeling exercise movement that more closely replicates the movement found in a corresponding free weight exercise, and a more uniform exercise of the entire deltoid muscle.

In each of the above embodiments, movement of the exercise arms into an outward, raised position is translated into rocking movement of a user support, making the exercise more enjoyable for the user and also providing a more uniform exercise to the deltoid muscles. This movement also provides a more comfortable, better feeling exercise that enhances the user's workout.

It should be understood that all the different elements used in the above embodiments may be mixed and interchanged with one another and still incorporate the essence of the above embodiments. The exercise arms may be mounted on the main frame, user support or connecting link. The connecting linkage could be made adjustable and could push or pull to urge rotation of the user support which can be made to rotate forward or rearward. The resistance may be associated with any of the moving parts (user support, exercise arm or connecting link).

It should also be noted that different types and forms of components could be used in the above embodiments. Cables could be replaced with belts, ropes, chains or the like, pulleys replaced with sprockets, and tubes could be replaced with solid rods or bars. The seat, back pad, and/or foot plate may be made adjustable. Other types of resistance known to the art could by used for providing exercise resistance, such as hydraulic, pneumatic, electro-magnetic, flex rod, or rubber band resistance devices or weight plates.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

We claim:

1. A lateral deltoid exercise machine, comprising:

a stationary main frame;

a user support pivotally mounted relative to the main frame and adapted to support a user in a forward facing exercise position, the user support being movable between an exercise start position and an exercise end position during a lateral deltoid exercise;

an exercise arm assembly having right and left exercise arms each pivotally mounted relative to the main frame for independent rotation about spaced first and second pivot axes and configured to move outwardly and upwardly from the respective exercise start positions to respective exercise end positions;

a connecting linkage between the user support and exercise arm assembly which links movement of the exercise arms to movement of the user support; and a load which resists movement of at least one of the exercise arm assembly, the user support, and the connecting linkage, wherein each of the spaced first and second pivot axes are substantially horizontal and have a substantially fore-aft orientation, and wherein each exercise arm includes a forearm engaging portion, the forearm engaging portion being adapted for engagement by a respective forearm of a user for performing a lateral deltoid exercise when the user is supported in an exercise position on the user support.

2. The apparatus of claim 1, wherein the connecting linkage includes a rigid swivel link pivotally mounted on the user support, the rigid swivel link having left and right ends which are respectively linked to the left and right exercise arms, whereby rotation of one or both exercise arms results in rotation of the user support.

3. The apparatus of claim 2, wherein the user support rotates through a first angle when both exercise arms are rotated and through half the first angle when only one exercise arm only is rotated.

4. The apparatus of claim 3, wherein the first angle is in the range from 14 to 17 degrees.

5. The apparatus of claim 2, wherein the connecting linkage further includes left and right drive links each having an upper end pivotally mounted on the respective left and right exercise arms and a lower end pivotally connected to the respective left and right ends of the rigid swivel link.

6. The apparatus of claim 5, wherein an upper left universal joint pivotally connects the upper end of the left drive link to the left exercise arm, a lower left universal joint pivotally connects the lower end of the left drive link to the left end of the rigid swivel link, an upper right universal joint pivotally connects the upper end of the right drive link to the right exercise arm, and a lower right universal joint pivotally connects the lower end of the right drive link to the right end of the rigid swivel link.

7. The apparatus of claim 2, wherein rotation of the left or right exercise arm from the exercise start position toward the exercise end position causes the respective left or right end of the rigid swivel link to move downward, which results in rotation of the user support.

8. The apparatus of claim 1, wherein the user support has at least primary and secondary supports which support spaced positions on a body of the user throughout a lateral deltoid exercise and move together throughout the exercise movement.

9. The apparatus of claim 8, wherein the secondary support comprises a foot plate assembly.

10. The apparatus of claim 9, wherein the user support further comprises a back rest.

11. The apparatus of claim 8, wherein the primary support comprises a user support seat and is configured to support the user in a seated, substantially upright position in the exercise start position.

12. The apparatus of claim 1, wherein the user support comprises at least a user support seat which supports the user in a seated position.

13. The apparatus of claim 12, wherein the user support is pivotally mounted on the main frame for rotation about a third pivot axis, and a vertical gravitational center line extending through the third pivot axis extends through the user support seat when the user support is in the exercise start position and in the exercise end position, whereby part of a weight of a user is located on each side of the gravitational center line throughout the exercise.

14. The apparatus of claim 13, wherein the vertical gravitational center line is located in front of the torso of a user seated in an exercise position on the user support in the exercise start position.

15. The apparatus of claim 1, wherein the user support is configured to rotate forward as it moves from the exercise start position to the exercise end position.

16. The apparatus of claim 1, wherein the user support is configured to rotate rearward during a lateral deltoid exercise.

17. The apparatus of claim 1, wherein the movement of the user support between the exercise start position and the exercise end position includes a forward and rearward rocking motion about a third pivot axis, the user support has a forward end and a rear end, and the forward end of the user support is linked to the load.

18. The apparatus of claim 1, wherein the user support is pivotally mounted for rotation about a third pivot axis that is substantially perpendicular to the spaced first and second pivot axes.

19. The apparatus of claim 1, wherein the connecting linkage extends from the exercise arm assembly to a portion of the user support that is forward of the user support's pivotal mounting point.

20. The apparatus of claim 1, wherein the connecting linkage extends from the exercise arm assembly to a rear portion of the user support.

21. The apparatus of claim 1, wherein the main frame includes a stationary upright assembly and the exercise arms are pivotally mounted on the stationary upright assembly at a location spaced above at least a major part of the user support.

22. The apparatus of claim 1, wherein each exercise arm further comprises a handle spaced forward from the respective forearm engaging portion for gripping by a hand of a user when performing a lateral deltoid exercise.

23. The apparatus of claim 1, wherein the forearm engaging portion comprises an arm pad.

* * * * *